United States Patent [19]

Shimono et al.

[11] Patent Number: 5,012,283

[45] Date of Patent: Apr. 30, 1991

[54] COPYING APPARATUS HAVING A LAMP TO FORM OR ERASE AN IMAGE

[75] Inventors: Mamoru Shimono; Tomoyuki Asada; Taiichi Kawaguchi; Yoichi Taya, all of Yokohama; Kouji Yukinaga, Kawasaki; Susumu Nomura, Kawasaki; Hajime Tagawa, Kawasaki, all of Japan

[73] Assignee: Kabushiki Kaisha Toshiba, Kawasaki, Japan

[21] Appl. No.: 466,674

[22] Filed: Jan. 17, 1990

[30] Foreign Application Priority Data

Jan. 20, 1989 [JP] Japan ..... 1-11614

[51] Int. Cl.[5] ..... G03G 15/04

[52] U.S. Cl. ..... 355/229; 355/228

[58] Field of Search ..... 355/234, 228, 69, 71, 355/218, 233, 210, 219, 220, 229, 232, 235; 219/216

[56] References Cited

U.S. PATENT DOCUMENTS 3,990,792 11/1976 Kono ..... 355/234

4,194,835 3/1980 Shiode ..... 355/234 X 4,259,711 3/1981 Mochizuki ..... 362/304

4,792,824 12/1988 Kozuka ..... 355/234

*Primary Examiner*—Arthur T. Grimley

*Assistant Examiner*—Sandra L. Hoffman

*Attorney, Agent, or Firm*—Foley & Lardner

[57] ABSTRACT

A copying apparatus includes a housing in which are arranged an image carrier and an exposure unit both for emitting light to an original placed on the original stand to form an electrostatic latent image on the image carrier and for emitting light to the image carrier to erase the electrostatic latent image. The exposure unit includes a lamp having light emitting portions and non-light emitting portions which are alternately connected together. A reflector is located around the lamp and directs the light emitted from the lamp toward the original. The reflector has a plurality of openings formed to face the lamp, so that part of the light emitted from the lamp passes through the openings and is directed to the image carrier. The reflector has a plurality of connecting portions facing the non-light-emitting portions and located between adjacent ones of the openings.

4 Claims, 22 Drawing Sheets

COPYING APPARATUS HAVING A LAMP TO FORM OR ERASE AN IMAGE

BACKGROUND OF THE INVENTION

1. Field of the Invention

The present invention relates to a copying apparatus which forms an image by use of electrophotographic technology.

2. Description of the Related Art

In recent years, electrophotographic copying apparatuses have come into use not only in offices and factories but also in ordinary homes. Under the circumstances, there is a demand for development of a copying apparatus which is compact in size, reliable in operation, and easy to handle.

Recently, a compact-in-size copying apparatus can be obtained by utilizing the light source of an exposure unit for electrically discharging a photosensitive drum. In this copying apparatus, a halogen lamp is employed in place of a fluorescent lamp, so as to stabilize the light source and shorten the actuation time.

However, a halogen lamp emits a far larger amount of heat than a fluorescent lamp. Therefore, the lamp may thermally damage a reflector for directing the lamp light in a predetermined direction.

In general, a charging unit must be accurately positioned with reference to a photosensitive drum, for reliably charging the photosensitive drum. A conventional copying apparatus comprises a charger frame supporting the charging unit and a support frame supporting the photosensitive drum, and the changer frame is not attached to the support frame but to another apparatus frame. With this construction, it is difficult to provide accurate positioning between the charging unit and the photosensitive drum.

In a copying apparatus capable of producing color copies, a plurality of developer cartridges containing different-color developers are prepared, and these cartridges are selectively loaded in the copying apparatus. To let the operator know the color of the developer to be used, a conventional copying apparatus comprises an electric circuit for detecting the type of developer cartridge loaded in the apparatus, and an indicator provided on the control panel of the apparatus to indicate results of the cartridge detection. Due to this construction, the conventional color copying apparatus includes a large number of parts or components, and is therefore complex and large in size.

Not only a developer cartridge used in a color copying apparatus but also a developer cartridge used in an ordinary monochromatic copying apparatus has a rotating shaft for agitating the developer, and a gear attached thereto. When the cartridge is loaded in a copying apparatus, the gear of the rotating shaft engagemens a driving gear provided in the copying apparatus. However, the gear of the rotating shaft and the driving gear of the copying apparatus do not always smoothly engage with each other. In some cases, the teeth of the two gears collide with each other, resulting in damage to the teeth. Therefore, the conventional copying apparatus is not very reliable in operation.

As mentioned above, the conventional copying apparatuses employ a large number of parts or components, so that it still has much room for miniaturization. In addition, the conventional apparatus is not satisfactorily reliable in operation.

SUMMARY OF THE INVENTION

The present invention has been developed in consideration of the above circumstances, and its object is to provide a copying apparatus which is made up of a small number of parts or components and is therefore compact in size, and which is reliable in operation and can be operated easily.

To achieve this object, the present invention provides a copying apparatus wherein a frame for supporting an image carrier and a frame for supporting a charging unit are integrally formed as one piece. Due to this construction, the number of parts is reduced, and the image carrier and the charging unit can be accurately positioned with reference to each other.

In the apparatus of the present invention, moreover, the optical means for converging light, emitted from the exposure means and reflected by an original, onto the image carrier is fixed directly to the frame supporting the image carrier. With this construction, the optical means can be positioned very accurately with reference to the image carrier. In addition, it is not necessary to employ a support member specially designed for supporting the optical means.

According to the present invention a copying apparatus comprises: a housing containing exposure means; an original table reciprocatingly mounted on the housing and on which an original is to be placed; drive means for reciprocating the original table by the number of times corresponding to the number of copies to be produced, when the original placed on the original table is scanned by the exposure means; and control means for decreasing the moving speed of the original table when the original table is moving back at the final reciprocating motion. The control means is connected to the exposure means and is adapted to reduce the amount of light emitted from the exposure means when the original table is moving back at each reciprocating motion.

As mentioned above, the moving speed of the original table is decreased when the original table is moving back at the final reciprocating motion. Therefore, the light exposure step is reliably completed by the time the reciprocating motion of the original comes to an end. Thus, when the operator opens the cover of the original table after the original table moves back, he or she does not see the exposure light and therefore does not feel unpleasant. This contributes to efficient handling of the copying apparatus. This advantage is ensured by reducing the light amount when the original table is moving back.

Moveover, according to the present invention, a developer cartridge in provided on its surface with an indicating section for indicating the type of the developer it contains, and the copying apparatus has an opening enabling the operator to look at the indicating section externally of the copying apparatus. The position of the opening is determined such that the light passing through the opening is not incident on the image carrier of the copying apparatus. With this construction, the apparatus does not have to employ electric circuit means for detecting the type of developer contained in a developer cartridge, nor does it have to employ electric display means connected to such electric circuit means. Therefore, the number of parts or components of the apparatus can be reduced, thereby making the apparatus compact. Further, the apparatus is free from any erroneous operation from use of the electric circuit means, thereby improving its reliability.

According to the present invention, a developer cartridge is fitted in the copying apparatus to be swingable within a predetermined angular range. By allowing the driving means to drive the agitation means provided in the developer cartridge, the developer cartridge swings within the predetermined angular range. As a result, the developer in the cartridge can be agitated very reliably. Since the drive means drives the agitation means and swings the cartridge, there is no need to provide a separate drive means for swinging the cartridge, so that this construction does not result in a increase in the number of parts or components of the copying apparatus.

BRIEF DESCRIPTION OF THE DRAWINGS

The accompanying drawings illustrate an electrophotographic copying apparatus according to an embodiment of the present invention, wherein.

DETAILED DESCRIPTION OF THE PREFERRED EMBODIMENT

An embodiment of the present invention will now be described, with reference to the accompanying drawings.

Figure 1:
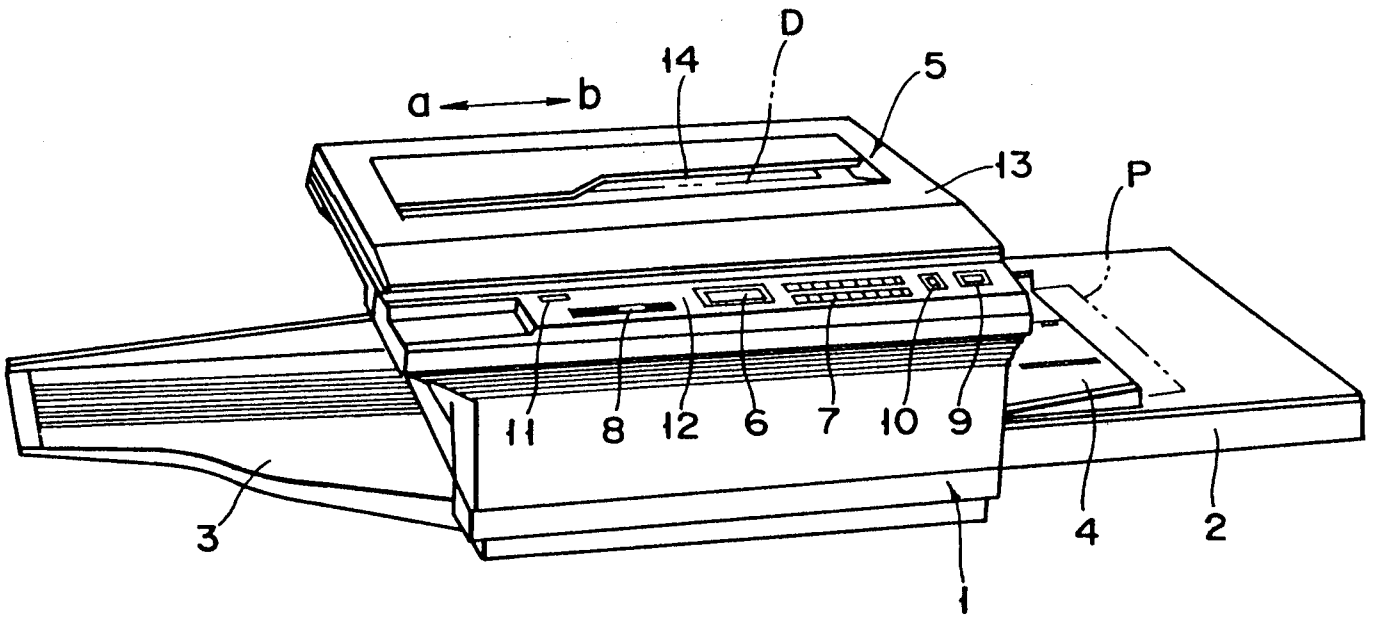
FIG. 1 is a perspective view of the copying apparatus.

FIG. 1 shows the outward appearance of an electrophotographic copying apparatus whose exposure unit also functions as a discharger. Referring to FIG. 1, the copying apparatus comprises housing 1. Paper supply cassette 2 is fitted into the right side of housing 1, and paper discharge tray 3 is fitted into the left side of housing 1. The upper surface of cassette 2 is provided with manual insertion tray 4, which is used for supplying paper sheets P (i.e., media onto which an image is transferred) into housing 1.

Original table 5 is arranged on the upper face of housing 1. This original table is reciprocatingly movable from side to side with reference to housing 1.

Control panel 12 is located on the upper portion of the front of housing 1. This control panel includes: display section 6 for displaying whether or not each unit of the apparatus is in a normal operating condition and for showing the number of copies set by the operator; copy number-setting keys 7 (i.e., a ten-key pad) with which the operator designates the number of copies to be produced; light adjuster 8 with which the toner density of a copy to be produced (i.e., the darkness of the copy) is adjusted; print key 9 (i.e., a copy key); clear/-stop key 10; and total counter 11.

The copying apparatus is capable of successively producing up to 99 copies. The number of copies set by the operator and indicated at display section 6 is reduced by one each time one copy is produced. Display section 6 shows [1] at the time of automatic clear mode and [0] when the copying apparatus is in the warm-up process.

The maximum number of copies successively produced by the apparatus can be increased up to nine copies by disconnecting a jumper connector (not shown) located inside control panel 12. In the successive copying mode of the apparatus, the operator can manually insert one paper sheet by depressing clear/-stop key 10. Original cover 13 (a platen cover) has original pocket 14 on the upper side thereof. If necessary, the operator can keep original documents D in pocket 14.

Figure 2:
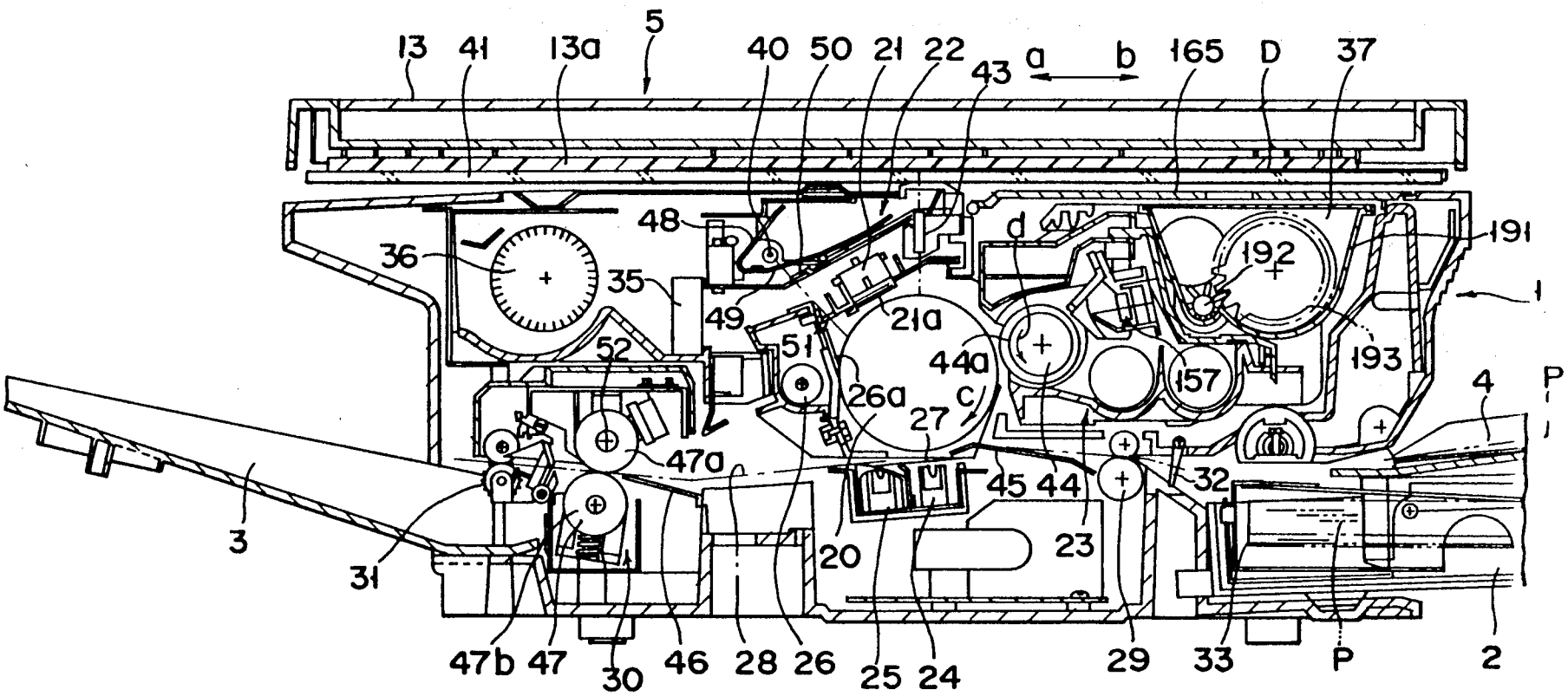
FIG. 2 is a longitudinal sectional view showing the internal construction of the apparatus.

As is shown in FIG. 2, photosensitive drum 20 as an carrier is located in the center of the interior of housing 1. This photosensitive drum is rotated in the direction indicated by arrow c by a drive mechanism (not shown) at a copying speed of 95 mm/sec, i.e., at a speed corresponding to the moving speed of table 5. Drum 20 is made up of an aluminum cylinder and a negatively charged type organic photoconductor. The organic photoconductor includes a charge generation layer formed on the surface of the aluminum cylinder, and a charge transport layer coated on the charge generation layer.

Around photosensitive drum 20, the following structural elements are arranged in the rotating direction thereof: charging unit 21 as charging means; exposure unit 22 as latent image-forming means which also functions as a discharger; developing unit 23 as developing means; charging unit 24 as transfer means used for image transfer; charging unit 25 as sheet-separating means for separating a sheet from drum 20; and cleaner unit 26.

Transfer path 28 is defined in the interior of housing 1. Along this transfer path, paper sheet P, which is fed from paper supply cassette 2 via paper supply mechanism 33 or from manual insertion tray 4, is guided to image transfer section 27 located between photosensitive drum 20 and charging unit 24. Paper sheet P is guided further to paper discharge tray 3 after an image is transferred onto it.

Aligning roller mechanism 29 is arranged on the unstream side transport path 28 with respect to image transfer section 27. Likewise, image-fixing unit 30 as image-fixing means and paper discharge roller mechanism 31 has a paper discharge means arranged on the downstream side in transport path 28 with respect to image transfer section 27. Aligning switch 32 is located in the vicinity of aligning roller mechanism 29.

In the inside of housing 1, the following structural elements are provided: ozone filter 35 for neutralizing the ozone generated by charging units 21, 24 and 25; cooling fan unit 36 for preventing the temperature in the interior of housing 1 from rising; and toner cartridge 37 fitted to developing unit 23.

During the copying operation, photosensitive drum 20 is rotated in the direction indicated by arrow c, and the surface thereof is charged by charging unit 21 such that it is applied with a voltage of −700 V. Charging unit 21 is provided with grid 21*a*, which is applied with a voltage of −750 V when the surface of drum 20 is charged by charging unit 21.

Original table 5 has original stand 41 formed of transparent glass. Original D placed on original stand 41 is uniformly irradiated with the light emitted from lamp 40 of exposure unit 22. The light reflected by original D is converged by convergence type optical transmitter 43 (trade name: Selfoc Lens Array) on the negatively-charged surface of photosensitive drum 20. As a result, an electrostatic latent image of original D is formed on the surface of drum 20. When the electrostatic latent image comes to the position facing developing unit 23, positive toner attaches to it, whereby the electrostatic latent image is visualized as a toner image.

Developing unit 23 includes developing roller 44 (i.e., a toner layer-holding member), which uses a magnetic brush of positive two-component developer. Sleeve 44*a* of roller 44 is rotated by a drive mechanism (not shown) in the direction indicated by arrow d. It is rotated faster than photosensitive drum 20; normally, the rotating speed of sleeve 44*a* is about 3.3 to 3.5 times as that of photosensitive drum 20. Sleeve 44*a* is kept applied with a bias voltage of −200 V.

In synchronism with the formation of the toner image, paper sheet P, which is taken out of paper supply cassette 2 or inserted from manual insertion tray 4, is guided to image transfer section 27 by aligning roller mechanism 29.

In image transfer section 27, paper sheet P is guided by guide 45 such that it is brought into contact with the surface of photosensitive drum 20. At this time, the toner image is transferred from photosensitive drum 20 onto paper sheet P by the negative charging action produced by charging unit 24. After the transfer of the toner image, paper sheet P is AC-charged by charging unit 25, whereby it is separated from the surface of photosensitive drum 20. Thereafter, paper sheet P is guided by guide 46 to image-fixing unit 30 having image-fixing roller mechanism 47. With paper sheet P fed through image-fixing roller mechanism 47, the toner image is fused and fixed to paper sheet P. Finally, paper sheet P is discharged onto paper discharge tray 3, being conveyed by paper discharge roller mechanism 31.

Image-fixing roller mechanism 47 includes fusing roller 47*a* and pressing roller 47*b*. Fusing roller 47*a* is obtained by coating Teflon-based resin on an aluminum core member, and contains heater 52 therein. Pressing roller 47*b* is formed of silicone rubber. Since the surface of fusing roller 47*a* is negatively charged, it attracts positive toner, so that the toner image may offset or pressing roller 47*b* may be stained with the toner. To prevent this problem, fixing unit 30 has a home position device (not shown) and a leaf spring (not shown). In the home position device, a PTFE in which carbon black is diffused is coated on fusing roller 47*a*, to thereby decrease the resistance of the resin layer. The leaf spring electrically grounds roller 47*a*.

After the transfer of the toner image onto paper sheet P, the toner remaining on photosensitive drum 20 is removed by cleaning blade 26*a* of cleaner unit 26. After this, the residual image on the surface of photosensitive drum 20 is erased with the discharging light emitted from exposure unit 22. In this way, photosensitive drum 20 is set in the initial state. The discharging light emitted from a lamp passes through a discharging light opening 49 formed in reflector 48 and incident on discharging light filter 50. After controlled in both amount and wavelength by filter 50, the discharging light passes through discharging light opening 51 formed in cleaner unit 26 and then falls on the surface of photosensitive drum 20.

Housing 1 is made up of upper and lower units, and the above-mentioned transfer path 28 is located in the boundary between the upper and lower units. The upper unit is rotatable upward around an axis (not shown). If the upper unit is rotated upward, most of transfer path 28 and the structural components provided along transfer path 28 are exposed. Therefore, jamming of paper sheet P can be easily eliminated, and the structural components of the apparatus can be easily maintained or replaced with new ones.

The major structural components of the subject copying apparatus will now be described in detail.

First of all, the structure and operation of table 5 will be described, with reference to FIGS. 2–7 and FIGS. 8A–8F.

Figure 3:
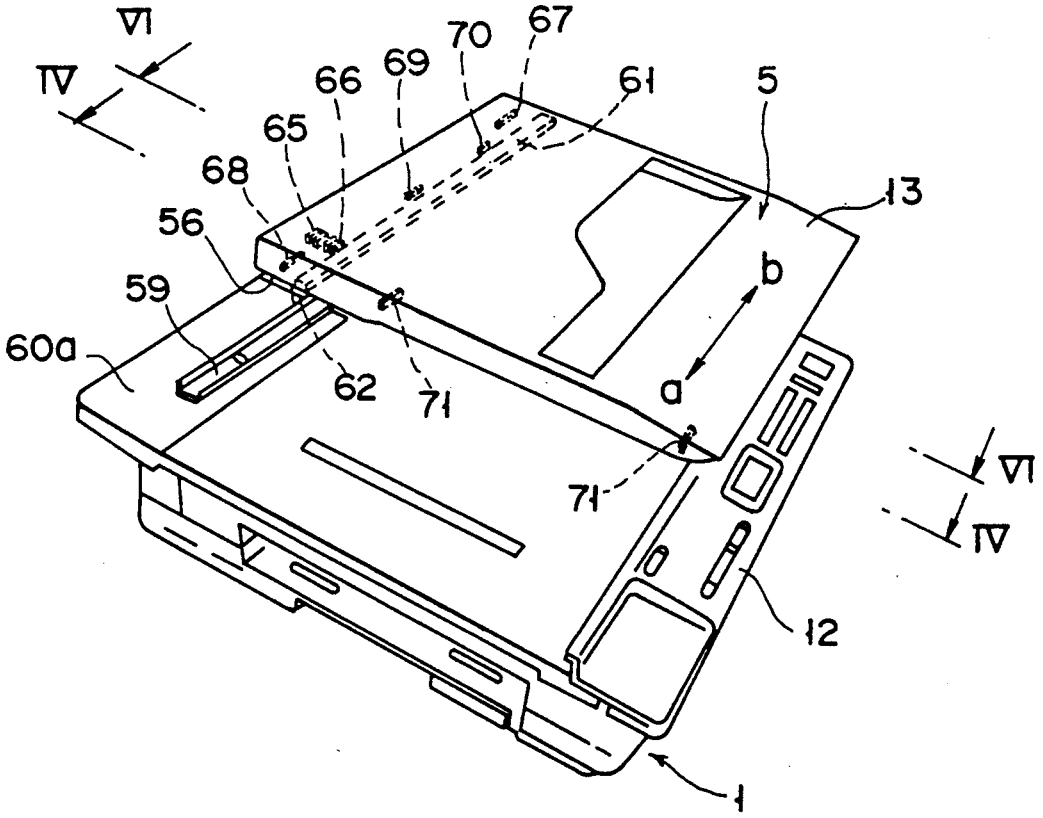
FIG. 3 is a perspective view showing a condition in which an original table has been advanced.

As is shown in FIGS. 2 and 3, table 5 includes original stand 41 on which original D is to be placed, and original cover 13 which can be opened or closed with reference to original stand 41. Cover 13 has platen sheet 13*a* for pressing original D against original stand 41 when cover is closed.

Figure 4:
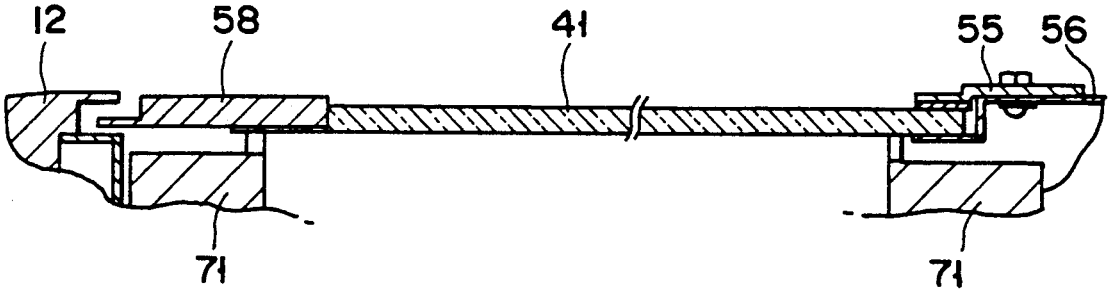
FIG. 4 is a sectional view taken along line IV—IV in FIG. 3.
Figure 5:
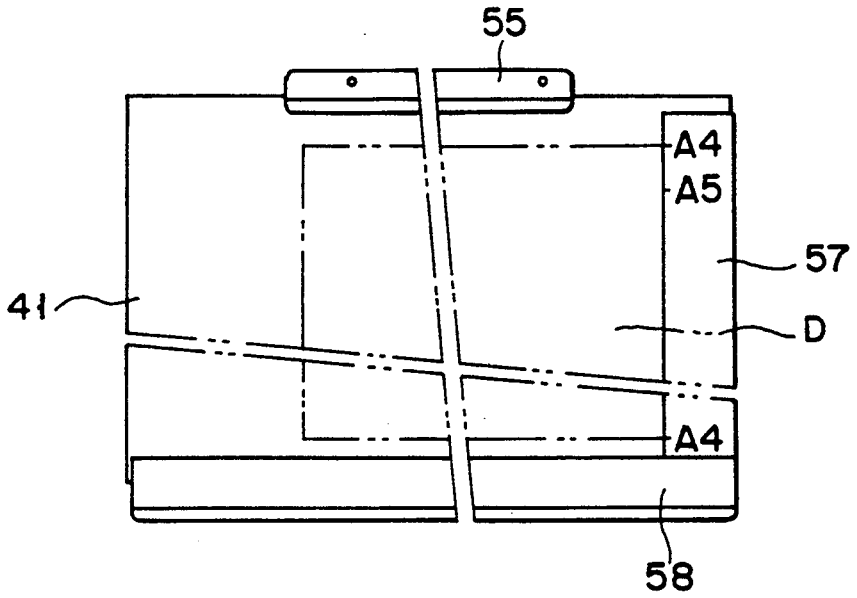
FIG. 5 is a plan view of the original table.

As is shown in FIGS. 4 and 5, the rear edge portion of original stand 41 is fixed to table frame 56 by glass holder 55. Scale 57, with reference to which original D is positioned on stand 41, is fixed to the right edge portion of stand 41, and frame member 58 is fixed to the front edge portion of stand 41.

Figure 6:
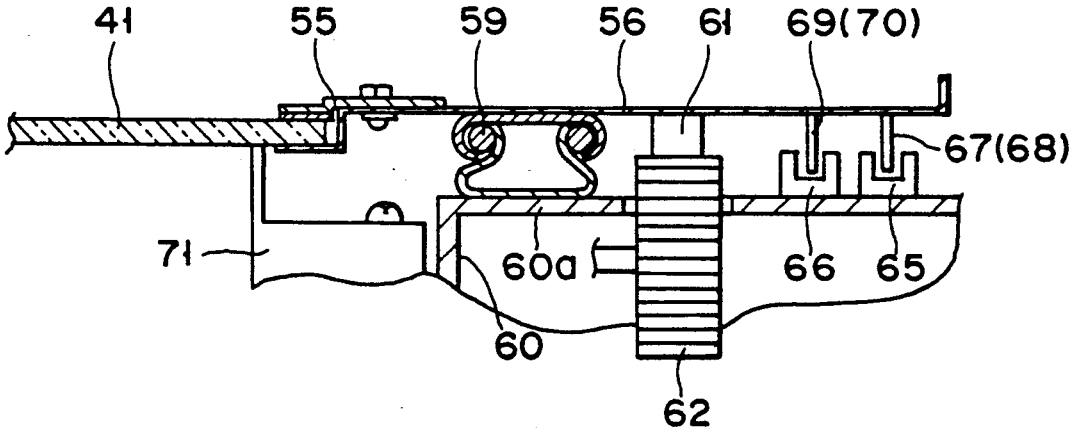
FIG. 6 is a sectional view taken along line VI—VI in FIG. 3.

As is shown in FIGS. 3 and 6, table frame 56 is attached through slider 59 to horizontal portion 60a, which is the rear portion of the upper surface of body frame 60. Rack 61 extending parallel to slider 59 is attached to the lower side of table frame 56. Rack 61 is in mesh with pinion 62 (i.e., a table-driving member) provided for housing 1. Table 5 is reciprocated in the leftward and rightward directions (which are respectively indicated by arrows a and b in FIG. 3) in response to the forward and reverse rotations of pinion 62.

First and second detectors 65 and 66 are arranged side by side on horizontal portion 60a of body frame 60. First detector 65 detects the limit position of the reciprocating motion of table 5, while second detector 66 detects both the home position of table 5 and the start position of a paper sheet. Detection elements 67, 68, 69 and 70 to be detected by first and second detectors 65 and 66 are arranged on table frame 65 such that they are spaced from one another in the moving direction of table 5. Element 67 is used for the detection of the left limit, element 68 is used for the detection of the right limit, element 69 is used for the detection of the home position of table 5, and element 70 is used for the detection of the start position of a paper sheet.

A pair of glass guides 71 formed of plastic are arranged on main body frame 60 such that they correspond in location to optical transmitter 43. These guides support the lower surface of glass holder 55 and that of frame member 58, and holds original table 5 at a predetermined position with reference to optical transmitter 43. The lower portion of the rear edge of original cover 13 is attached to table frame 56 by a hinge mechanism (not shown). Therefore, original cover 13 can be rotated, so as to expose or cover original table 5. If necessary, original cover 13 can be easily removed from frame 56.

Figure 7:
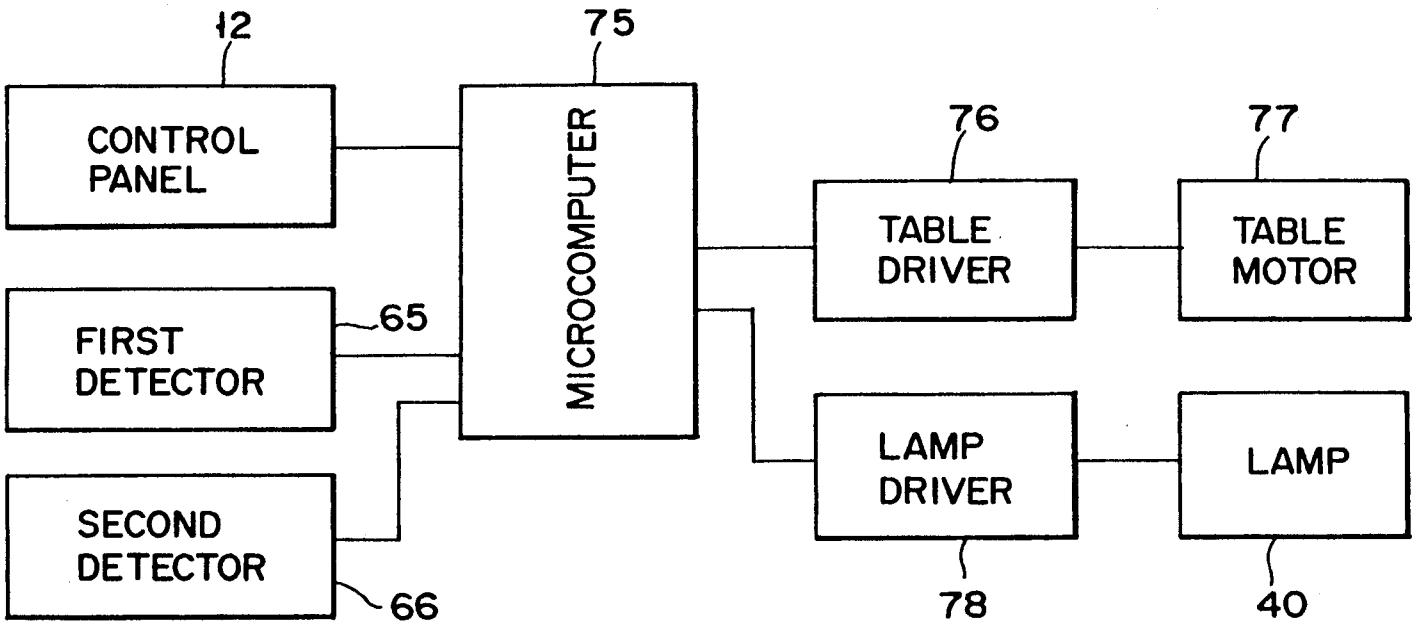
FIG. 7 is a block diagram showing part of the control system used for controlling both a table motor and a lamp.

As is shown in FIG. 7, first and second detectors 65 and 66 are connected to microcomputer 75 as control means. Control panel 12 mentioned above is also connected to microcomputer 75. Further, table motor 77 for driving pinion 62 is connected to microcomputer 75 through table driver 76, and lamp 40 is connected to microcomputer 75 through lamp driver 78 as a lamp-driving source.

FIGS. 8A through 8F illustrate how the movement of table 5 and the amount of exposure light are controlled.

Figure 8A:
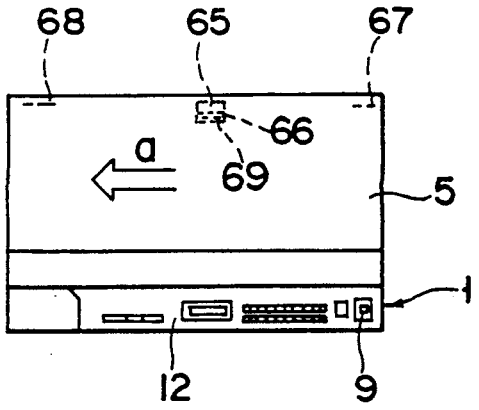
FIGS. 8A through 8F are schematic views illustrating different operating conditions of the original table.
Figure 8B:
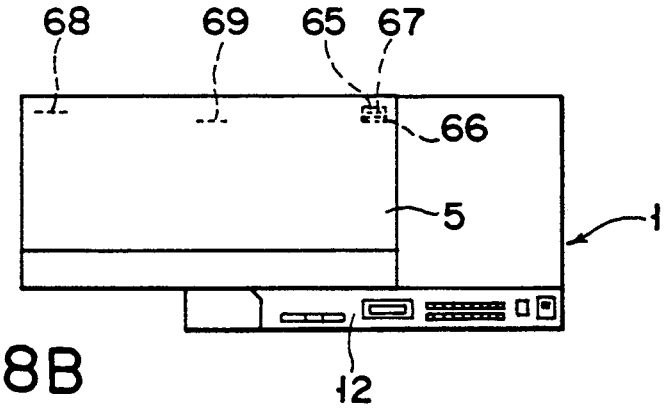
Figure 8C:
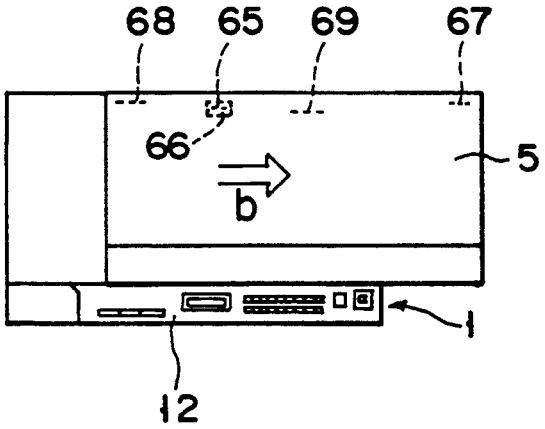
Figure 8D:
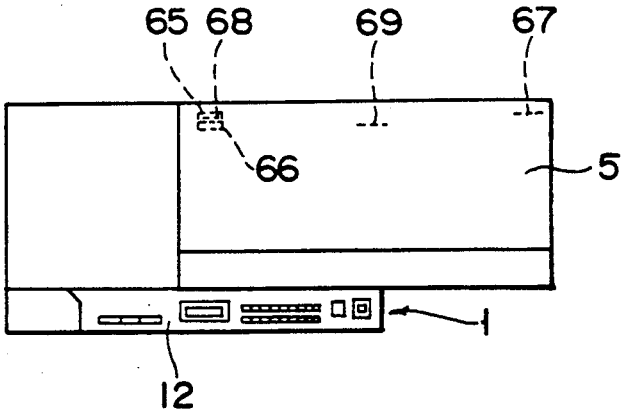
Figure 8E:
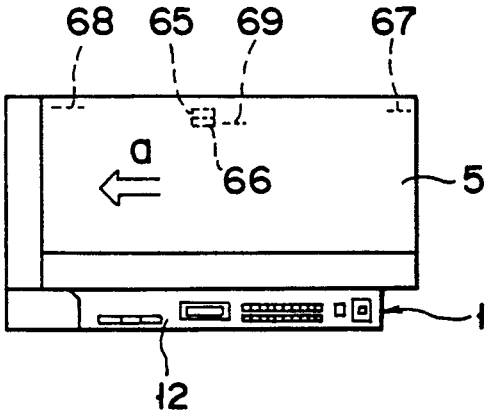
Figure 8F:
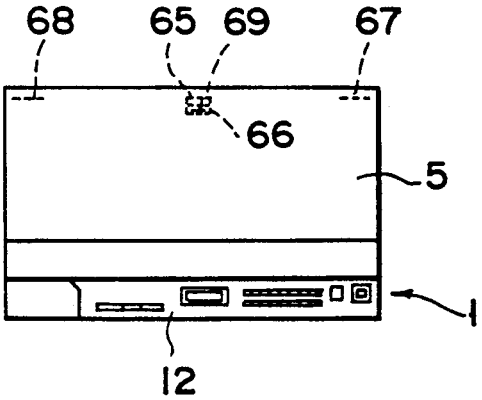

As is shown in FIG. 8A, table 5 is normally at the home position, where it covers the upper face of housing 1. In response to the operation of print key 9, table 5 starts moving leftward (i.e., in the direction indicated by arrow a in FIG. 8A). As is shown in FIG. 8B, table 5 comes to a halt when detection element 67 is detected by first detector 65. Next, table 5 starts moving rightward (i.e., in the direction indicated by arrow b in FIG. 8C) with original D on original table 5 scanned by exposure unit 22. In response to this scanning operation, the above-mentioned process of forming an electrostatic latent image is carried out. When original D is being scanned, lamp 40 is set in the high-level condition necessary for the light exposure of original D. As is shown in FIG. 8D, table 5 comes to a halt when the scanning of original D is completed, i.e., when detection element 68 is detected by first detector 65. Thereafter, table 5 starts moving leftward (i.e., in the direction indicated by arrow a in FIG. 8E), as is shown in FIG. 8E. When detection element 69 is detected by second detector 69, it comes to a halt, as is shown in FIG. 8F. In other words, table 5 returns to the home position thereof.

If the operator designates two or more copies should be produced, then the above process is successively repeated.

In the case where table 5 is returning to the home position at the final reciprocating motion (i.e., in the case where it is in the condition shown in FIGS. 8E and 8F after the scanning operation corresponding to the last one of a designated number of copies), table motor 77 is rotated slowly in response to a control signal supplied from microcomputer 75. Since, therefore, table 5 is moved slowly in this case, the electrically discharging process can be completed before table 5 returns to the home position. In other words, when table 5 returns to the home position, the electrically discharging process is reliably completed, and exposure lamp 40 is in the OFF state. Even if the operator opens original cover 13 immediately after table 5 stops, so as to replace original D with another, no exposure light is emitted at the time. Therefore, the operator is prevented from being dazzled or experiencing unpleasantness.

When table 5 is slowly returning to the home position, the amount of light emitted from lamp 40 is reduced to the value necessary just for electric discharge, in response to the above-mentioned control signal supplied from microcomputer 75. In this way, a temperature rise of photosensitive drum 20 and the reduction of power consumption are prevented.

In the case where table 5 is returning to the home position but not at the final reciprocating motion (i.e., in the case where it is still in the process of a successive copying operation), table motor 77 is rotated fast in response to a control signal supplied from microcomputer 75 so that table 5 moves in the direction a at a speed about twice as high as the speed at which it moves in the direction b, thereby quickly performing the next copying operation. Not only when table 5 is returning to the home position at the final reciprocating motion but also when it is returning during the process of the successive copying operation, the amount of light emitted from lamp 40 is reduced to the value necessary just for electric discharge, in response to the above-mentioned control signal supplied from microcomputer 75.

A description will be given of charging unit 21 as charging means, with reference to FIGS. 9 through 14.

Figure 9:
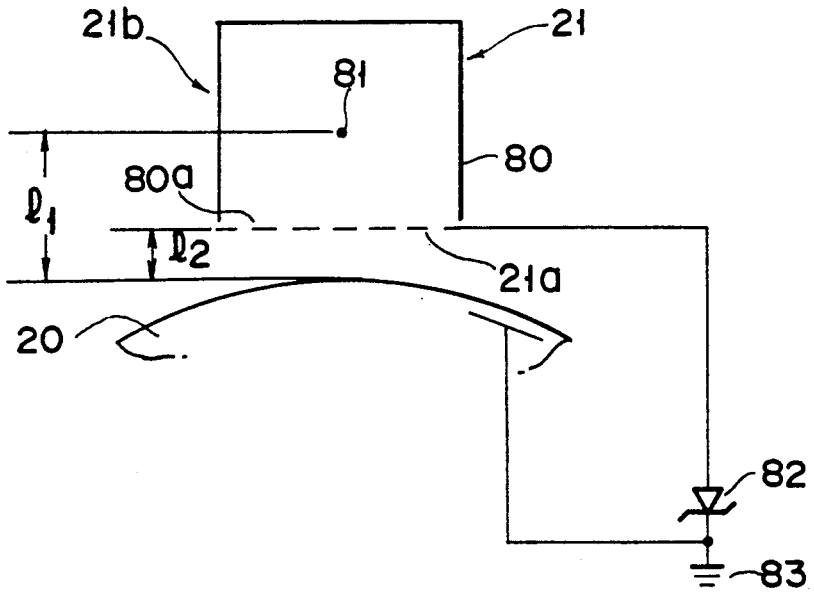
FIG. 9 is a schematical view showing the basic construction of a charging unit.

As is shown in FIG. 9, charging unit 21 is enclosed by shield case 80 which has opening 80a located in opposition to photosensitive drum 20. Charging unit 21 is formed of a scorotron including: main body 21b within which a corona wire 81 extends, and grid 21a arranged in opening 80a of case 80. Since photosensitive drum 20 is a negatively-charged type, charging unit 21 should perform a negative discharge. In the case of a negative discharge, it is likely that photosensitive drum 20 will not be uniformly charged. In order to permit drum 20 to be uniformly charged, therefore, grid 21a is arranged in opening 80a of case 20, as mentioned above.

Figure 10:
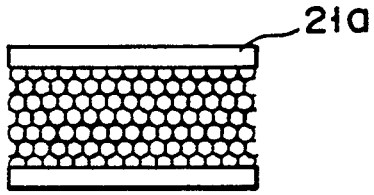
FIG. 10 is a plan view of part of the grid of the charging unit.

Grid 21a is of such a net type as is shown in FIG. 10. The width of each mesh of grid 21a is about 1 to 2 mm. Grid 21a is connected to the anode of Zener diode 82 maintained at −750 V and is connected further to ground terminal 83 of housing 1 though the cathode of Zener diode 82.

Charging unit 21 is supplied with a high voltage by a transformer (not shown) provided for housing 1. (The output of the transformer is −5.0 kV, and the total current value thereof is about 300 μA.) The surface potential of photosensitive drum 20 is slightly lower than the potential at grid 21*a*; it is maintained at −700 V. The diameter of photosensitive drum 20 is 60 mm, the distance l1 between drum 20 and corona wire 81 is 8.0 mm, and the distance l2 between drum 20 and grid 21*a* is 2.0 mm.

Figure 11:
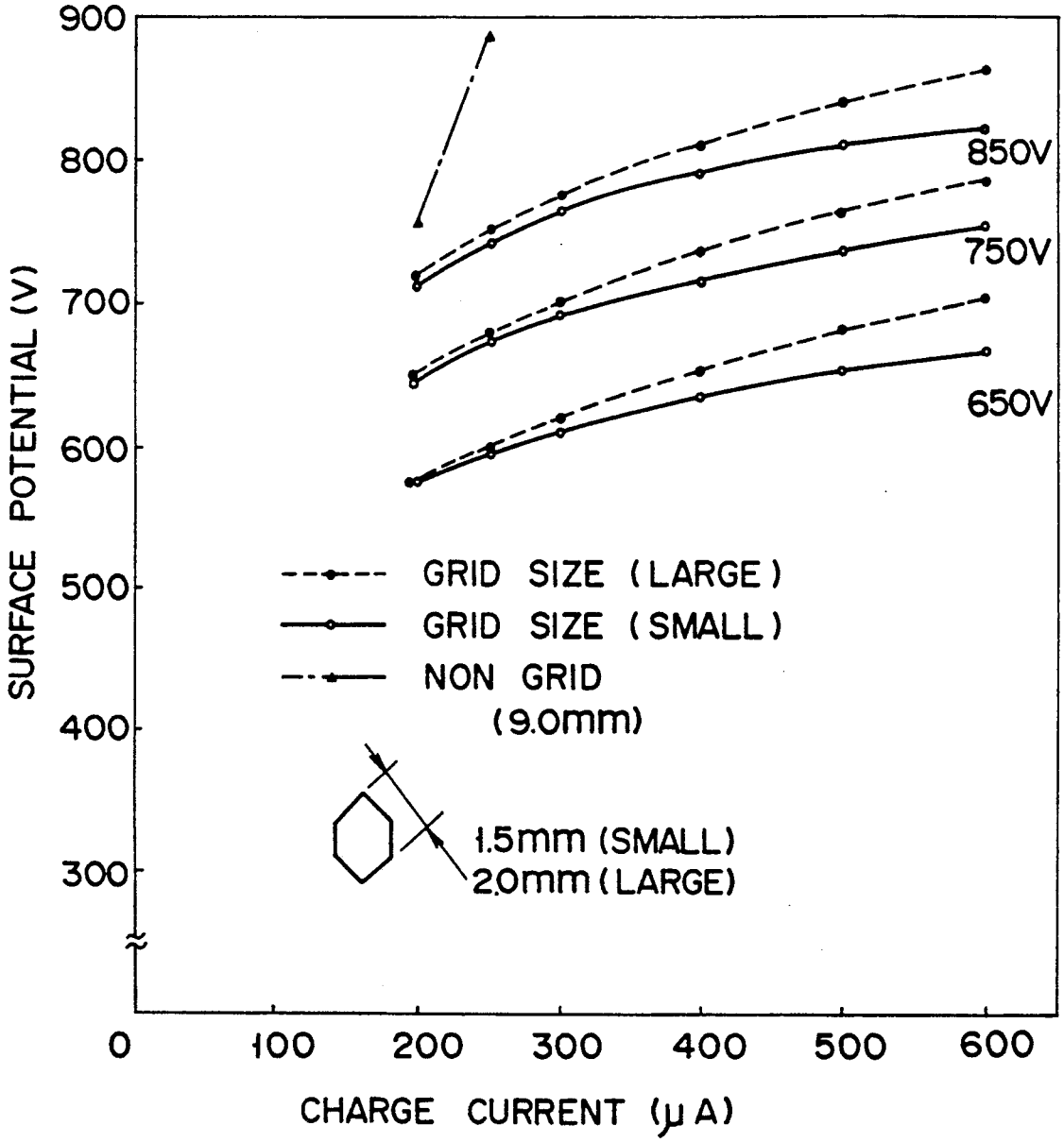
FIG. 11 is a graph showing how a charging current and a surface potential vary in relation to grids of different sizes.

The graph shown in FIG. 11 shows how drum 20 is charged by charging unit 21. As may be understood from this graph, the surface potential of drum 20 is stable due to the use of grid 21*a*, even if the current supplied to corona wire 81 varies.

Figure 12:
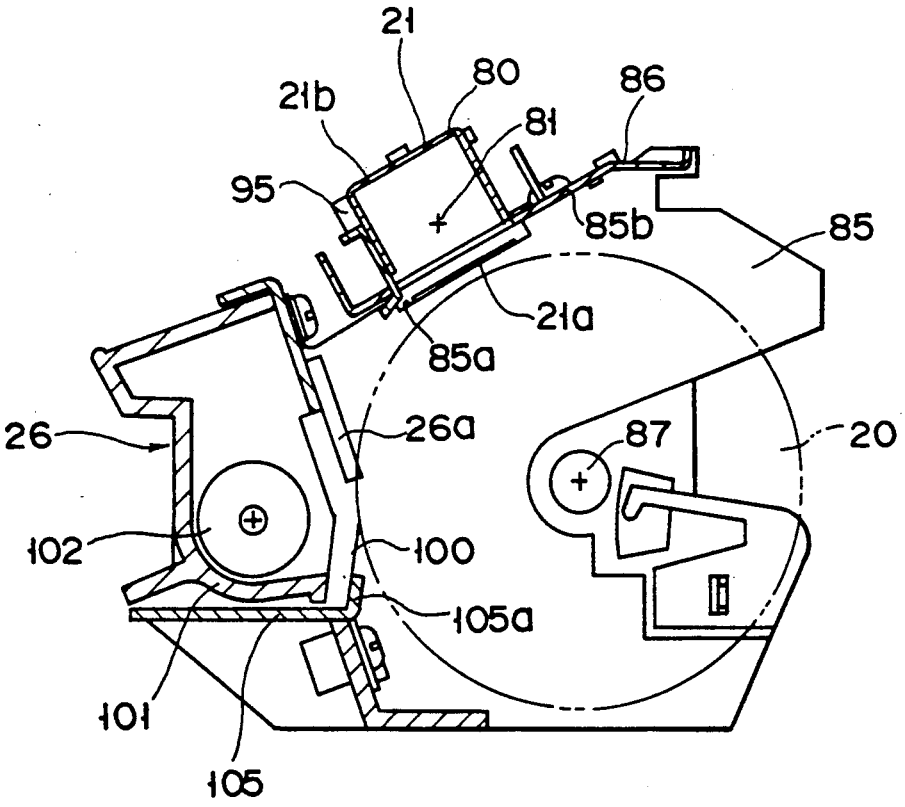
FIG. 12 is a sectional view showing a mounting structure of the charging unit and a cleaner unit.

As is shown in FIG. 12, charging unit 21 is attached to a pair of parallel side frames 85 of cleaner unit 26 through charger frame 86. Drum-supporting shaft 87 of photosensitive drum 20 is also supported by side frames 85.

Figure 13:
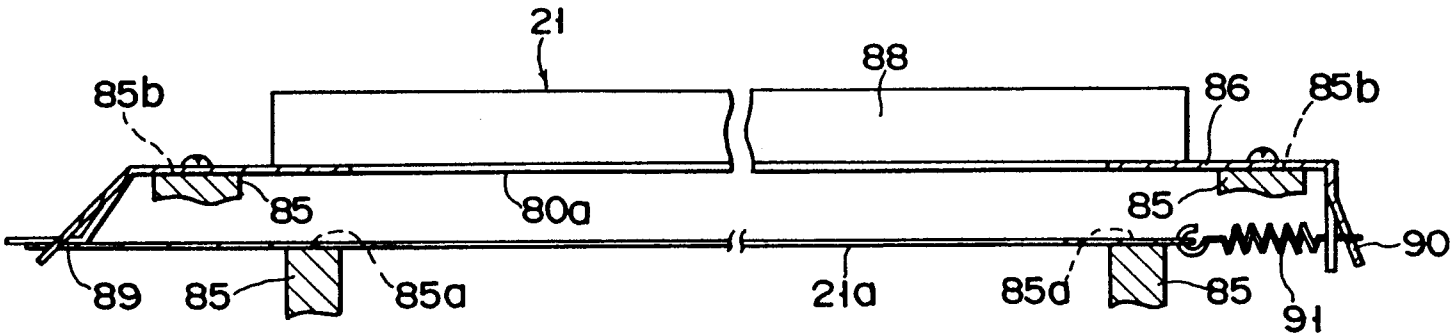
FIG. 13 is a view illustrating how the grid of the charging unit is positioned.
Figure 14:
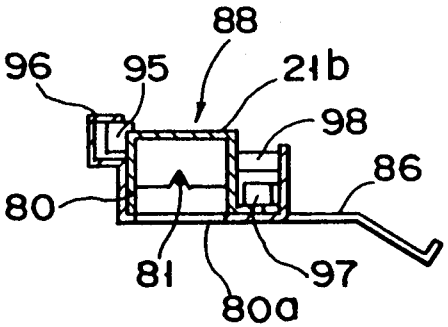
FIG. 14 is a view illustrating how the body of the charging unit is positioned.

As is shown in FIGS. 13 and 14, charger frame 86 has receiving section 88 adapted to receive main body 21*b* of charging unit 21, and extends in parallel to drum 20. First and second grid support portions 89 and 90 are provided at the respective longitudinal ends of charger frame 86. To support grid 21*a*, an engagement hole (not shown) formed at one end thereof is engaged with first grid support portion 89, and an engagement hole (not shown) formed at the opposite end thereof is engaged with second grid support portion 90 through coil spring 91. With this construction, grid 21*a* is supported within opening 80*a* of case 80 and kept parallel to drum 20. In addition, grid 21*a* is prevented from curling due to spring 91. The lower face of end portions of grid 21*a* are in direct contact with on grid support faces 85*a* of side frames 85. Therefore, distance l2 (FIG. 9) between the surface of photosensitive drum 20 and grid 21*a*, which is a factor having an important influence on the charging characteristics, can be maintained at the optimal value. Thus, a stable charging characteristics can be obtained.

As is shown in FIG. 14, shield case 80 has claw 95 formed of plastic, and is engaged through this claw with holding frame 96 integrally formed with charger frame 86. With this construction, main body 21*b* of charging unit 21 is mechanically held within receiving section 88. Further, in receiving section 88 are provided first leaf spring 97 for urging main body 21*b* downward, and second leaf spring 98 for urging main body 21*b* widthwise. With this construction, main body 21*b* can be accurately positioned within receiving section 88.

As is shown in FIGS. 13 and 14, charger frame 86 is fixed, by screws, to charger frame-supporting faces 85*b* of side frames 85. Supporting faces 85*b* have a predetermined positional relationship with drum-supporting shaft 87. With this construction, distance l1 (FIG. 9) between corona wire 81 and the surface of photosensitive drum 20 (which distance is a factor having an important influence on the charging characteristics) can be maintained at an optical value, resulting in satisfactory charging characteristics.

As is shown in FIG. 12, cleaner unit 26 comprises: cleaning blade 26*a* for scraping residual toner off the surface of photosensitive drum 10; member 100 (hereinafter referred to as a recovery blade) located under blade 26*a* and having a free end in contact with the surface of photosensitive drum 10, so as to prevent the scraped toner from scattering in housing 1; cleaner case 101 in which the scraped toner is collected; recovery auger 102 for transferring the toner from cleaner case 101 to a toner recovery box (not shown). The lower end portion of recovery blade 100 is supported by recovery blade-supporting member 105.

Figure 15:
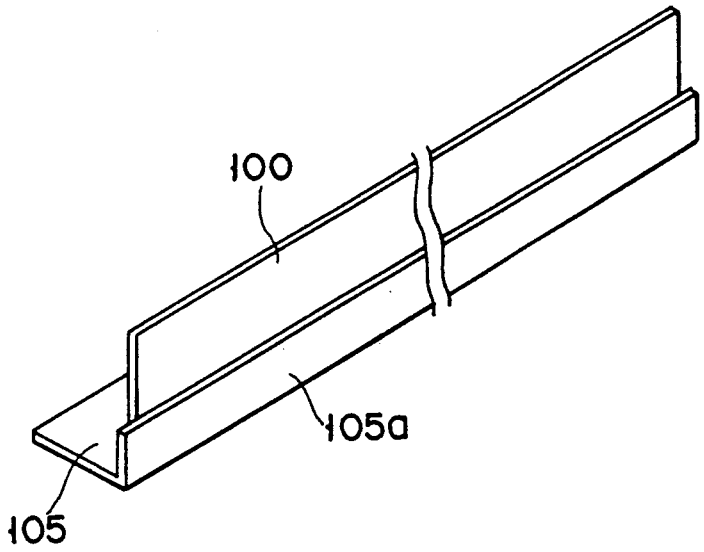
FIG. 15 is a perspective view of a recovery blade of the cleaner unit.
Figure 16:
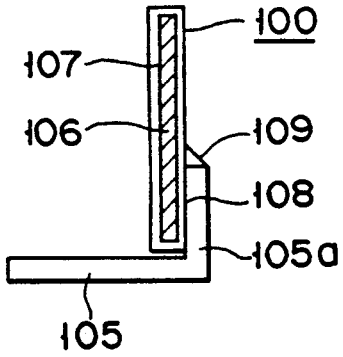
FIG. 16 is a sectional view of the blade.

As is shown in FIGS. 15 and 16, recovery blade 100 is made by coating conductive material 107 on the entire surface of non-conductive elastic member 106. Blade 100 is attached to vertical portion 105*a* of supporting member 105 by double-sided adhesive tape 108. Further, conductive material 107 of recovery blade 100 is connected to supsporting member 105 by conductive adhesive 109, so that recovery blade 100 is held in the grounded condition.

With the above construction, recovery blade 100 neutralizes the residual toner scraped off photosensitive drum 20, so that the attraction of the residual toner to drum 20 is suppressed. As a result, the residual toner can be efficiently removed from drum 20. If a non-conductive recovery blade is employed, as in a conventional copying apparatus, the residual toner remains charged even after it is scraped off a photosensitive drum. With an increase in the number of copies produced, therefore, more and more toner attaches to the back side of a cleaning blade, adversely affecting the efficient removal of residual toner.

A description will be given of exposure unit 22 which also serves as an electric discharger, with reference to FIGS. 17 through 21.

Figure 17:
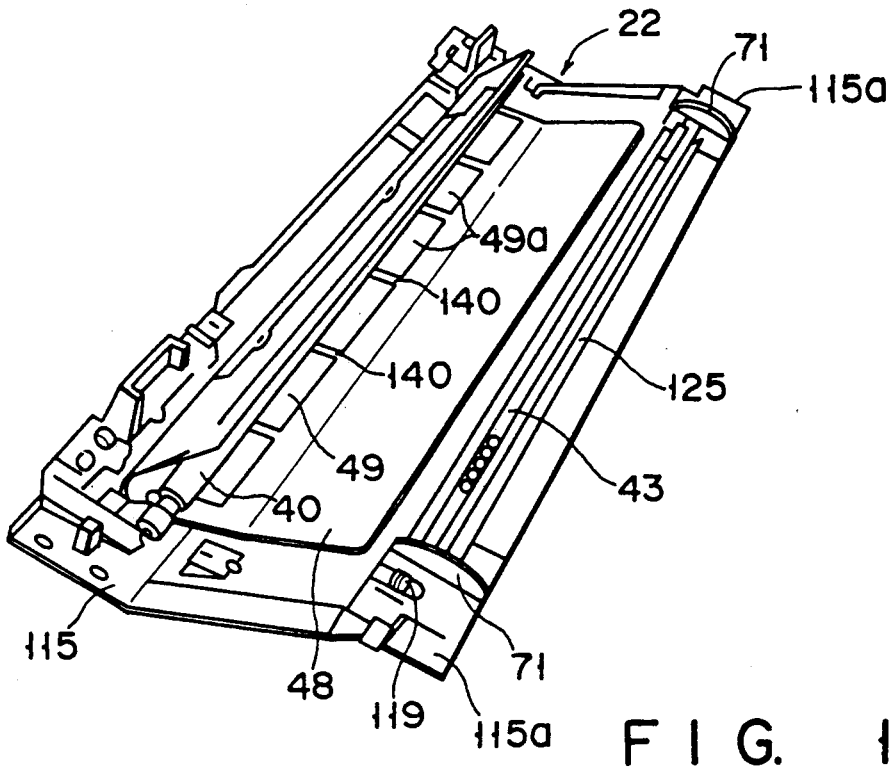
FIG. 17 is a perspective view of an exposure unit.

As is shown in FIG. 17, exposure unit 22 comprises reflector 48, lamp 40, convergence type optical transmitter 43, and glass guides 71. These structural elements are attached to optical system frame 115 to form an optical unit, and this frame 115 is fixed to body frame 60.

Figure 18:
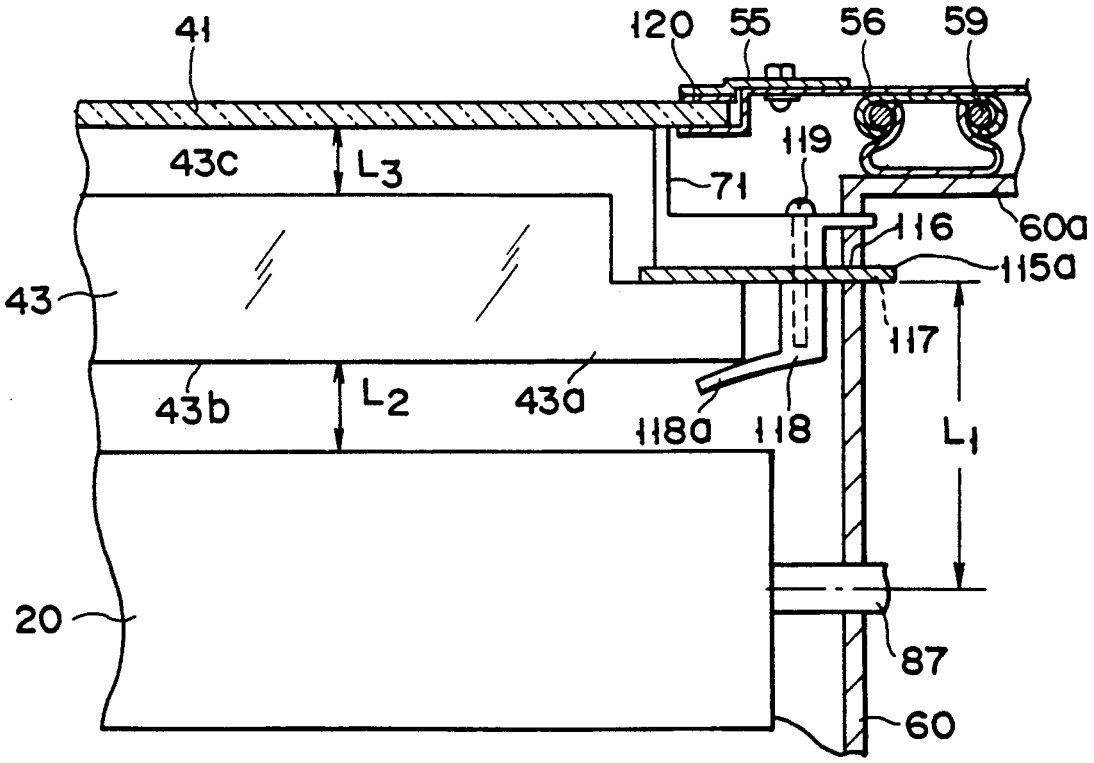
FIG. 18 a sectional view showing a mounting structure of a light convergence type optical transmitter of the exposure unit.

As is shown in FIG. 18, optical system frame 115 has a pair of fitting end portions 115*a* to which optical transmitter 43 is attached. Fitting end portions 115*a* extend through openings 116 formed in main body frame 60, and their lower faces are in contact with positioning portions 117, which are lower faces of openings 116. Positioning portions 117 are located away from drum-supporting shaft 87 by predetermined distance L1.

Each of abutting portions 43*a* (only one of which is shown) at the ends of optical transmitter 43 is clamped between the lower face of fitting portion 115*a* of optical system frame 115 and elastic piece 118*a* of support member 118. In this fashion, optical transmitter 43 is fitted to optical system frame 115. Support members 118 are attached to fitting portions 115*a* of optical system frame 115 by means of screws, together with glass guides 71.

With the construction mentioned above, distance L2 between the surface of photosensitive drum 20 and light-output end face 43*b* of optical transmitter 43 is determined by the position at which fitting portions 115*a* of optical system frame 115 are attached to body frame 60.

Distance L3 between original table 5 and light-incident end face 43*c* of optical transmitter 43 is determined by the following factors: the thickness of fitting portions 115*a*; the position at which fitting portions 115*a* are attached to body frame 60; and the dimension of glass guides 71. Distance L3 can be accurately maintained at a predetermined value by increasing the accuracy of distance L1, thickness of fitting portions 115*a*, and dimension of guides 71.

In a conventional copying apparatus, an optical transmitter is fixed to an optical system frame by merely using screws, so that the distance between the optical transmitter and the optical system frame is likely to vary. In the conventional copying apparatus, moreover, an original stand of the original table is supported only by a slider. Since the position of this slider may be easily shifted in the vertical direction, it is difficult to accurately maintain distance L3 at a predetermined value. These problems have been solved by the above-mentioned construction of the embodiment.

Elastic member 120, formed of rubber or the like, is located between original stand 41 and glass holder 55. Since stand 41 can be slightly raised if glass guide 71 pushes stand 41 upward, an intense contact force is not generated between stand 41 and glass guide 71, thereby preventing damage of stand 41.

Figure 19:
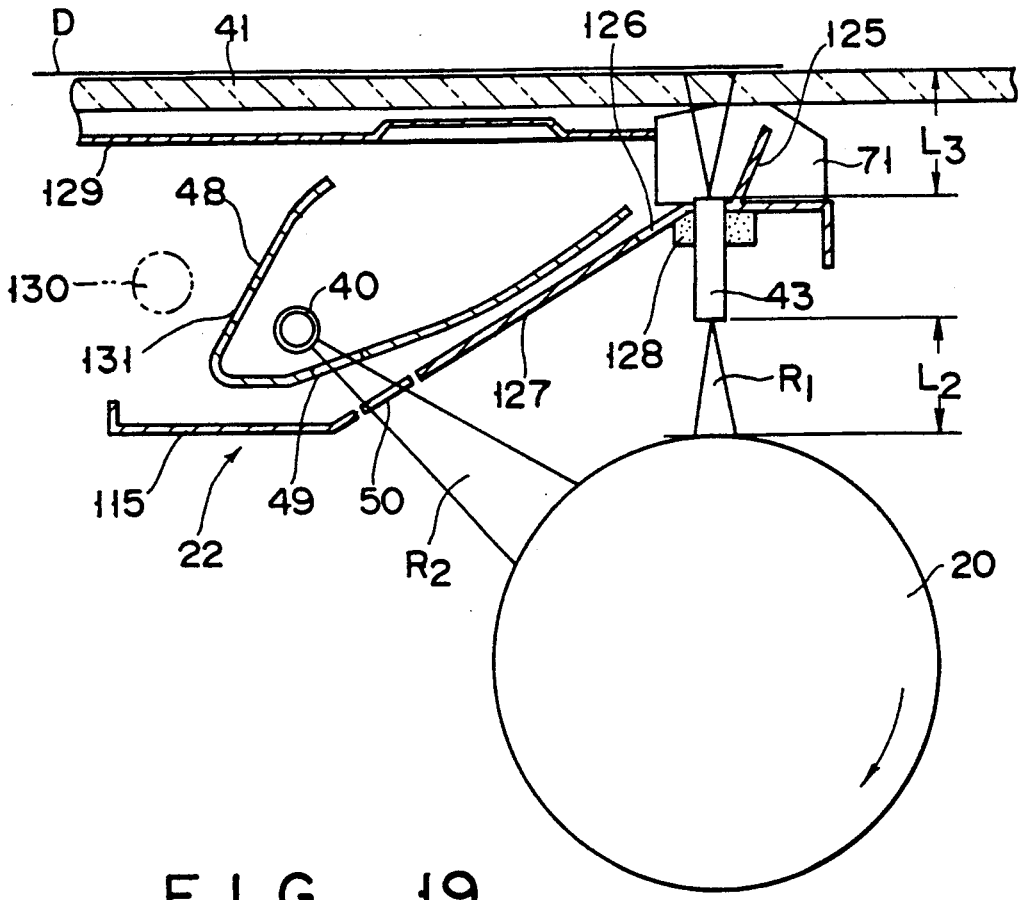
FIG. 19 is a sectional view schematically showing the exposure unit together with its neighboring structural components.

As is shown in FIG. 19, auxiliary reflector 125 is located in the vicinity of optical transmitter 43. Auxiliary reflector 125 is formed by cutting and raising part of optical system frame 115 in such a manner as to leave opening 126 in frame 115. Optical transmitter 43 is inserted in this opening 126, with light-incident end face 43c exposed to original stand 41. The gap which is left after inserting optical transmitter 43 in opening 126 is stopped up with both synthetic resin plate 127 and soft foam resin member 128. Therefore, the light reflected by original D does not leak through the gap toward photosensitive drum 20.

Discharging light filter 50 is provided so as to close an opening formed in optical system frame 115. Filter 50 is held on frame 115 by a holding member (not shown). In FIG. 19, reference numeral 129 denotes an optical system cover, 130 denotes a temperature fuse, and 131 denotes an opening which is formed in reflector 48 to enhance the sensitivity of temperature fuse 130.

Figure 20:
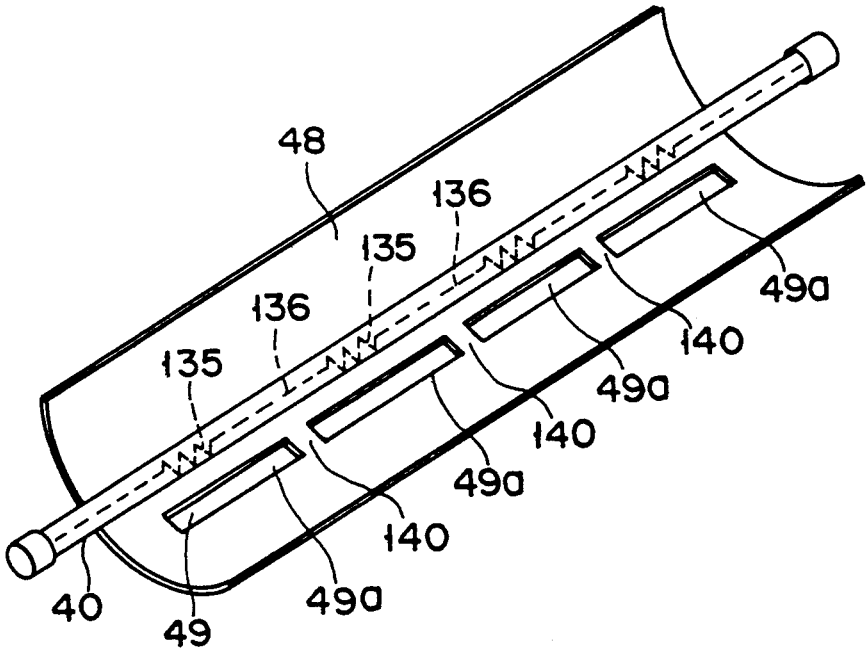
FIG. 20 is a perspective view of the lamp and reflector of the exposure unit.

As is shown in FIGS. 19 and 20, lamp 40 is a halogen lamp including a plurality of filaments 135 as light emitting portions and a plurality of short-circuiting portions 136 as non-light-emitting portions. Filaments 135 and short-circuiting portions 136 are alternately connected to one another. Lamp 40 having this construction is brighter than an ordinary fluorescent lamp, and does not require much waiting time before its illuminance becomes stable. Reflector 48 surrounding lamp 40 has discharging light port 49, through which discharging light R2 is directed toward photosensitive drum 20. Discharging light port 49 is not a single elongated slit, as in a conventional copying apparatus, but is constituted by a plurality of openings 49a which are defined between rib, as connecting members. Due to provision of ribs 140, reflector 48 is mechanically strong and is prevented from being thermally deformed.

Figure 21:
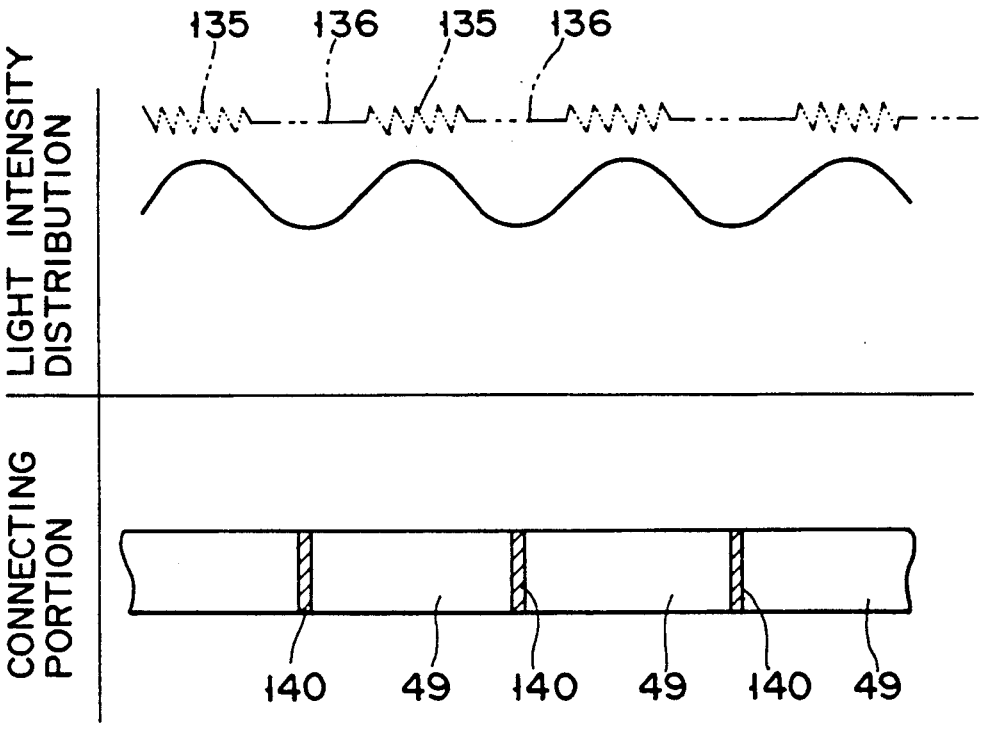
FIG. 21 is a view showing the light distributing characteristics of the lamp in relation to the arrangement of the ribs in a discharging light port.

As is shown in FIGS. 20 and 21, ribs 140 are located in correspondence to short-circuiting portions 136 of lamp 40, while openings 49a are located to face filaments 135. Therefore, the light emitted from lamp 40 is not shut off by ribs 140, thus permitting photosensitive drum 20 to be uniformly discharged. Incidentally, in the lengthwise direction of lamp 40, each rib 140 is shorter than, at least, the corresponding short-circuiting portion 136.

If ribs 140 are located to face filaments 135 of lamp 40, part of discharging light R2 will be lost, so that photosensitive drum 20 cannot be uniformly discharged.

Next, a description will be given of developing unit 23, with reference to FIGS. 22 through 29.

Figure 22:
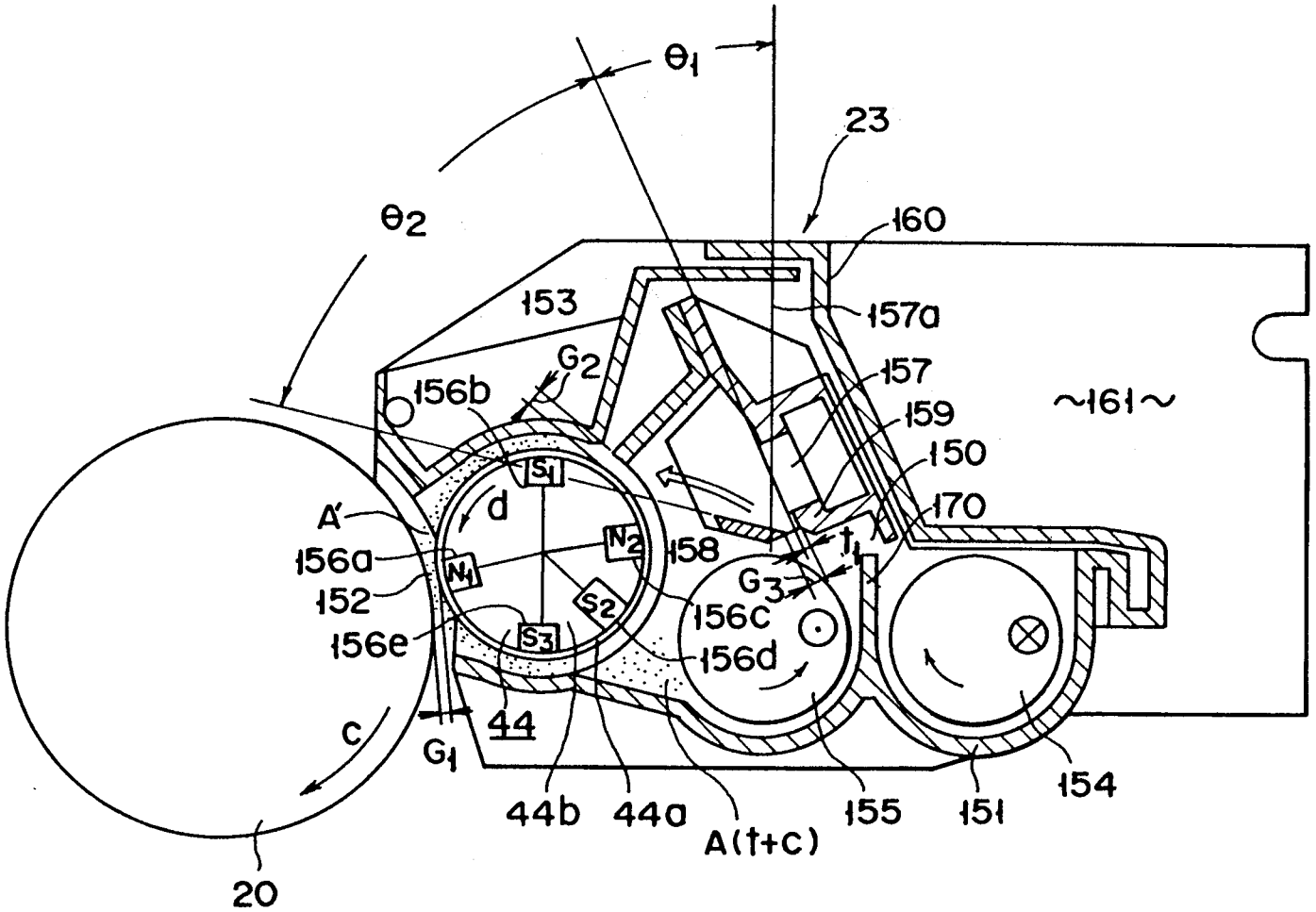
FIG. 22 is a sectional view of the developing unit.

As is shown in FIG. 22, developing unit 23 comprises casing 151, the interior of which defines developer-storing region 150, and developing roller 44 arranged in region 150 so as to face photosensitive drum 20. Two-component developer A, made up of toner t (coloring powder) and carrier c (magnetic powder), is stored within region 150. Magnetic brush A' of developer is formed on the surface of developing roller 44, and this magnetic brush A' is brought into sliding con tact with photosensitive drum 20 at developing position 152. Doctor 153 for regulating the thickness of magnetic brush A' is located upstream of developing position 152 with reference to the rotating direction of drum 20. First and second developer agitators 154 and 155 are located in region 150.

Developing roller 44 is formed of magnetic roll 44b having five magnetic poles 156a–156e, and nonmagnetic sleeve 44a fitted around magnetic roll 44b and rotatable in the counterclockwise direction (in the direction indicated by arrow d). Of the five magnetic poles of magnetic roll 44, magnetic pole 156a facing developing position 152 and its opposite magnetic pole 156c serve as N-poles, while the remaining magnetic poles 156b, 156d and 156e serve as S-poles.

Gap G1 between sleeve 44a and photosensitive drum 20 is in the range of 0.9 to 1.0 mm, and gap G2 between doctor 153 and sleeve 44 is in the range of 0.8 to 0.9 mm.

Automatic toner sensor 157 for controlling the toner density in two-component developer A is located above second agitator 155. Sensing face 157a of sensor 157 is slanted by angle $\theta 1$ ($\theta 1 = 12°$) with reference to the vertical direction, and by $\theta 2$ ($\theta 2 = 59°$) with reference to developer-receiving plate 158. Sensing face 157a should be slanted as above, so as both to stabilize the toner density and to uniformly distribute magnetism in sleeve 44a.

With the above construction, developer A uniformly flows inside casing 151 of developing unit 23. In order to ensure the stable operation of developing unit 23, sensing face 157a of sensor 157 should be projected from the surface of holder 159 by t1 (t1=0.7 mm), and gap G3 between the lowermost portion of holder 159 and developer-receiving plate 158 should be 2.5 mm.

Figure 23:
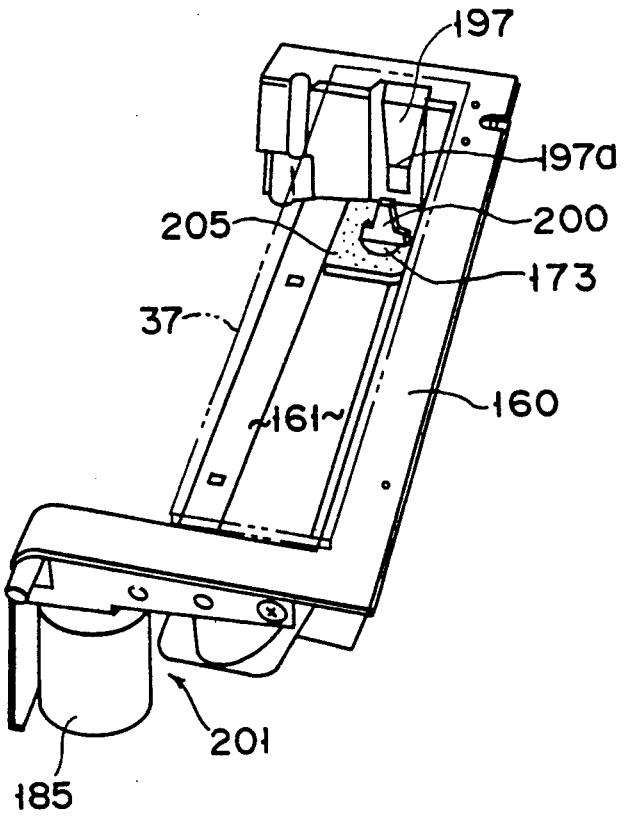
FIG. 23 is a perspective view of a developer cover.

As is shown in FIGS. 22 and 23, developing unit 23 is provided with cover 160 for closing developer-storing region 150. Cover 160 has section 161 in which a toner cartridge is loaded. Developing unit 23 is also provided with a carrying handle (not shown), for easy portability. As is shown in FIG. 24, developing unit 23 can be easily taken out of the copying apparatus by opening upper cover 165, with table 5 shifted in the leftward direction, as is shown in FIG. 24.

Normally, four developing units 23 respectively containing black toner, red toner, blue toner and brown toner are prepared, and are selectively used for the copying operation.

Figure 24:
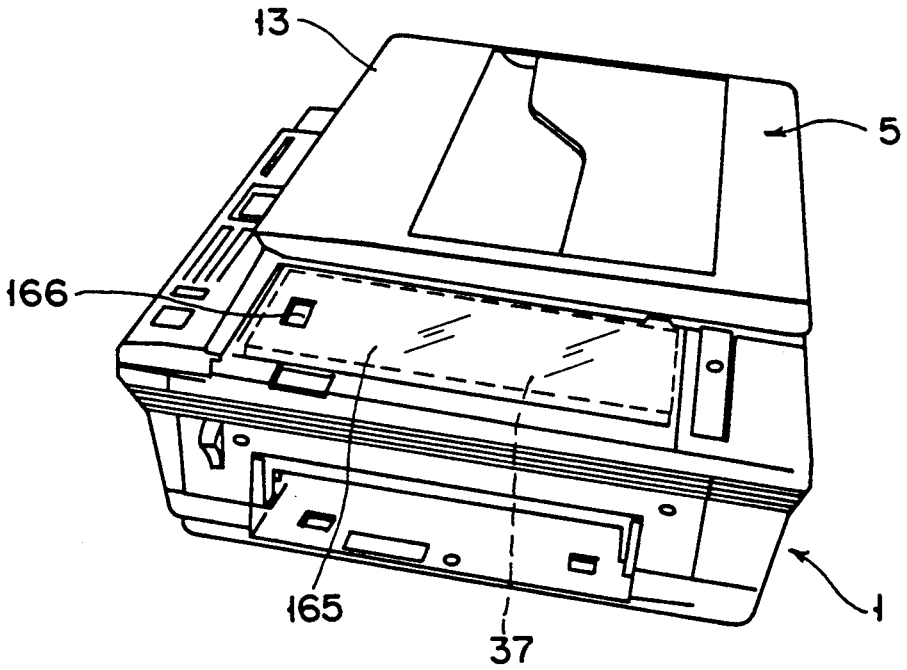
FIG. 24 is a perspective view showing the copying apparatus, with the original table moved.
Figure 25:
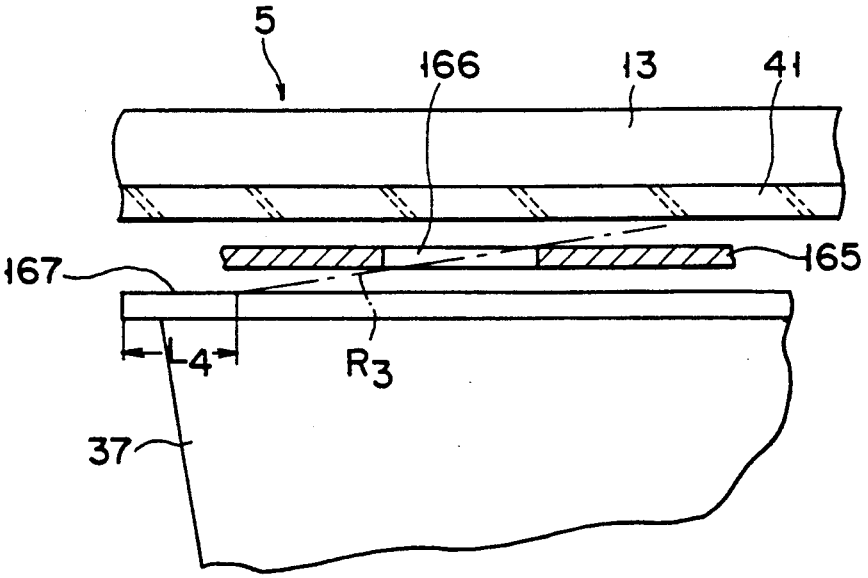
FIG. 25 is a sectional view showing a condition in which stray light coming from a color-indicating section is shut off.

As is shown in FIGS. 24 and 25, upper cover 165 has an opening serving as toner color-indicating section 166, and label 167 for showing the color of toner is attached to the upper face of cartridge 37 such that label 167 faces toner color-indicating section 166. Therefore, the operator can know which type of developing unit 23 is fitted in the copying apparatus without bothering to open upper cover 165, in other words, by simply looking at the color of label 167 attached to toner cartridge 37. Even when table 5 is at the home position, the operator can visually recognize label 167 through both original stand 41 and toner color-indicating section 166 by opening original cover 13.

As is shown in FIG. 25, the location of toner color-indicating section 166 is determined such that the stray light R3 entering the interior of housing 1 of the copying apparatus through section 166 is intercepted by the upper portion of toner cartridge 37. More specifically, section 166 is formed such that stray light R3 falling on section 166 at the smallest possible angle of incidence reaches the point located away from the end of toner cartridge 37 by distance L4. Therefore, stray light R3 is prevented from falling on photosensitive drum 20.

As mentioned above, toner color-indicating section 166 is no more than an opening. Therefore, the copying apparatus of the embodiment is small-sized and simple in construction and can be manufactured at a lower cost than that of a conventional apparatus, wherein the color type of loaded developing unit is electrically detected by use of dip switches and wherein that indicator of the control panel corresponding to the detected color type is turned on. It should be also noted that section 166 attracts the attention of the operator when the operator opens original cover 13 to set original D on original stand 41. Therefore, the operator never fails to recognize the color of the toner before starting the copying operation.

Figure 26:
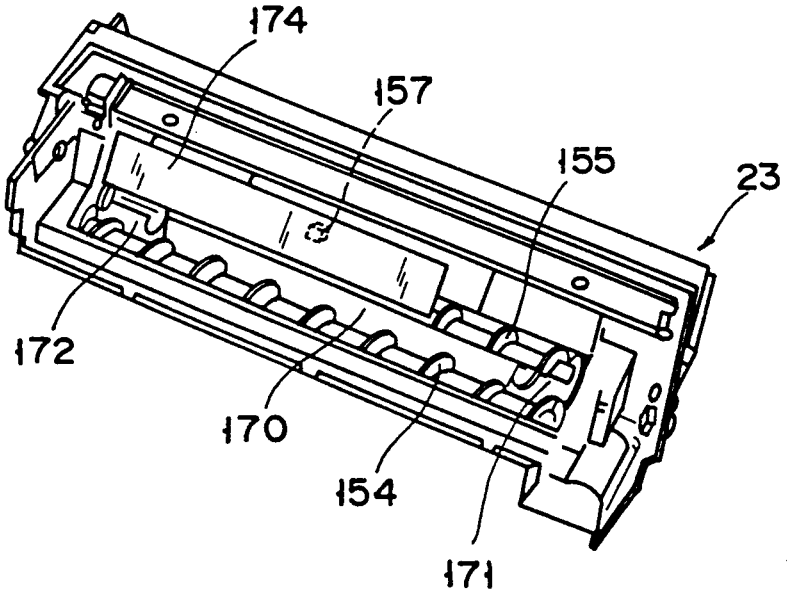
FIG. 26 is a perspective view of the developing unit while its cover is removed.
Figure 27:
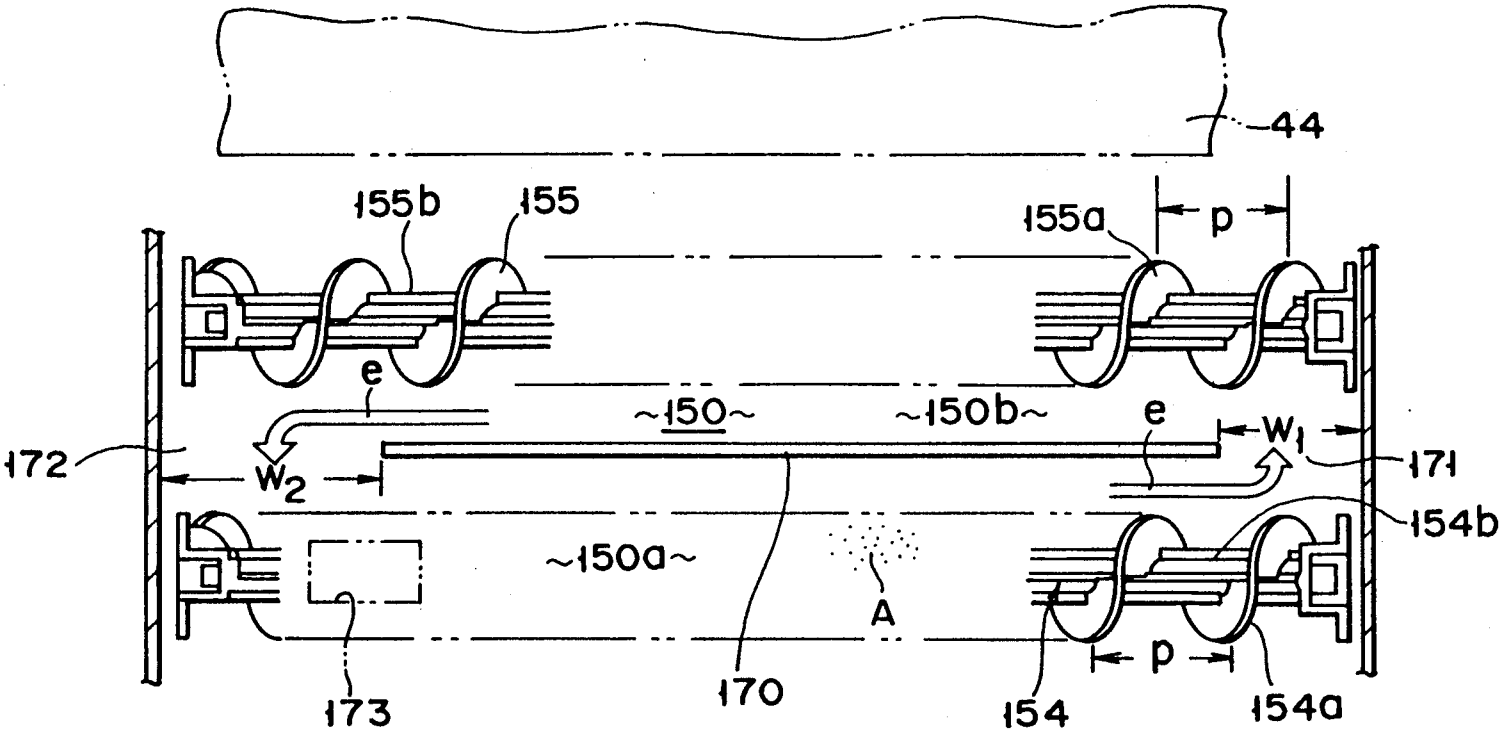
FIG. 27 is a view showing how the developer in the developer container flows.

As is shown in FIGS. 22, 26 and 27, first and second agitators 154 and 155 are arranged in developer-storing region 150. First agitator 154 includes rotating shaft **154*b*, and helical blade 154*a* formed on rotating shaft 154*b*. Similarly, second agitator 155 includes rotating shaft 155*b*, and helical blade 155*a* formed on rotating shaft 155*b*. Helical blades 154*a* and 155*a* are formed in the same direction and have the same pitch (p=25 mm), and shafts 154*b* and 155*b* are rotated in the opposite directions. Partitioning plate 170 is located between first and second agitators 154 and 155, to thereby define first agitating chamber 150*a* in which first agitator 154 is located, and second agitating chamber 150*b* in which second agitator 155 is located. Partitioning plate 170 has first and second communication regions 171 and 172 at the respective longitudinal ends thereof. Through these communication regions, first and second agitating chambers 150*a* and 150*b* communicate with each other. When agitators 154 and 155 are rotated, developer A stored in region 150 is circulated in the direction indicated by arrow e in FIG. 27**.

Cover 160 of developing unit 23 has toner-replenishing port 173 (FIGS. 23 and 27) which opens into the upstream region of first agitating chamber **150*a*. The width W1 of first communication region 171, through which the downstream region of first agitating chamber 150*a* and the upstream region of second agitating chamber 150*a* communicate with each other, is equal to pitch p of blades 154*a* and 155*a* (W1=p). That is, width W1 is 25 mm. With this construction, developer A is made to smoothly flow from the downstream region of first agitating chamber 150*a* into the upstream region of second agitating chamber 150*b*. Unlike first communication region 171, the width W2 of second communication region 172, through which the downstream region of second agitating chamber 150*b* and the upstream region of first agitating chamber 150*a* communicate with each other, is greater than greater than pitch p of first and second blades 154*a* and 155*a* (W2>p). That is, width W2 is 35 mm. If width W2 is smaller than p, it is likely that part of developer A will stay in second agitating chamber 150*b*, resulting in leakage of developer A from developing roller 44. However, this problem does not occur in the copying apparatus of the embodiment. Moreover, developer A is fully agitated in first agitating chamber 150*a*, so that the toner density detected by automatic toner sensor 157 (FIGS. 22 and 26) corresponds accurately to the toner density at the location of developing roller 44**.

As is shown in FIG. 26, protection sheet 174 is arranged within developer-storing region 150 and covers the front side of automatic toner sensor 157 for the purpose of protecting sensor 157 from the moisture or the like. Sheet 174 is removed when developing unit 23 is loaded in the copying apparatus.

Figure 28:
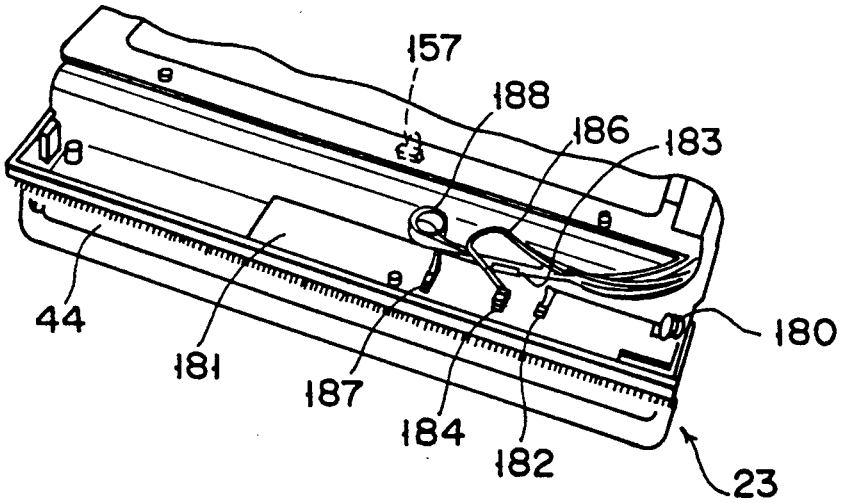
FIG. 28 is a perspective view showing a mounting structure of an automatic toner-adjusting control circuit board of the developer unit.

As is shown in FIG. 28, developing unit 23 has circuit board 181 for automatically adjusting the toner density in developer A. Circuit board 181 includes adjustment volume 180 used for adjusting the output ON/OFF level of automatic toner sensor 157. Signal cables 183, 186 and 188 are connected to circuit board 181 through first, second and third connectors 182, 184 and 187, respectively. Signal cable 183 extends from automatic toner sensor 157. Signal cable 186 extends from toner-replenishing motor 185 (FIGS. 23 and 29) to be mentioned later. Signal cable 188 extends from the control section of the copying apparatus and is used for sending output detection signals.

Before loading developing unit 23 of each color in the copying apparatus, the operator adjusts the output ON/OFF level of automatic toner sensor 157 by turning adjustment volume 180 with a screwdriver or the like, so as to permit a copy to be produced with a predetermined desirable developer density. After the output ON/Off level of sensor 157 is adjusted in this fashion, the operator is only required to load developing unit 23 in the copying apparatus. In connection with this, it should be noted that a conventional copying apparatus has an adjustment volume provided for the main body of the copying apparatus, not for the developing unit. Therefore, the operator has to remember the output level of each developing unit and adjust the adjustment volume in accordance with the output level of each developing unit. In the case of the present embodiment, a copy can be produced with a desirable developer density, with no need to make such troublesome adjustment.

Figure 29:
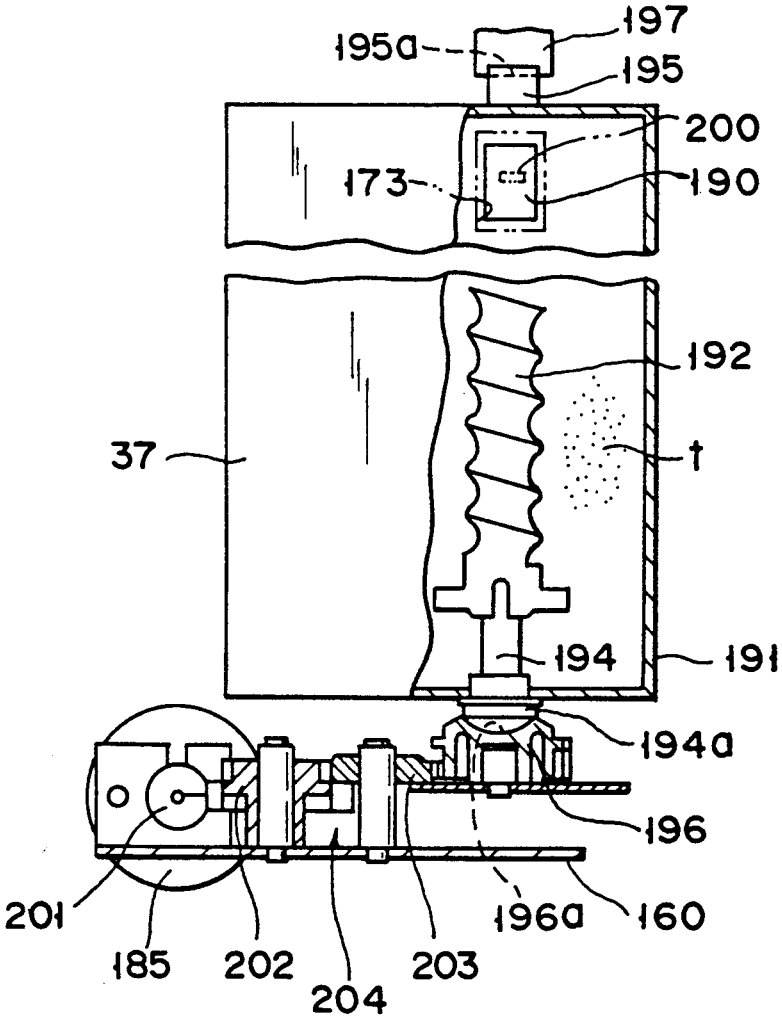
FIG. 29 is a view of a drive system for a toner transfer auger incorporated in a toner cartridge.
Figure 31:
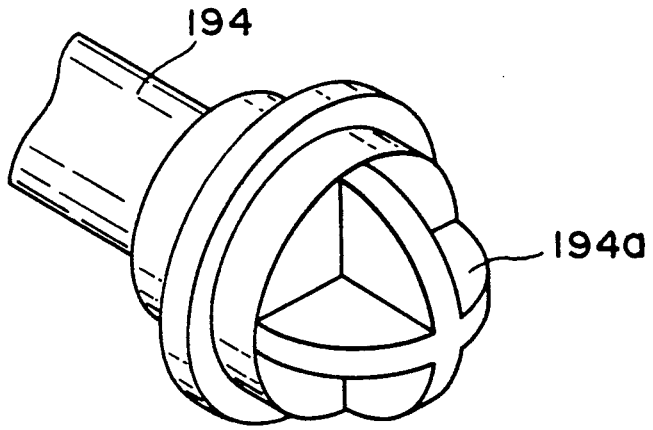
FIG. 31 is a perspective view of an engaging projection.

As is shown in FIGS. 2 and 29, toner cartridge 37 comprises: container 191 having toner-replenishing port 190 in the bottom thereof; toner transfer auger 192, arranged inside container 191, for transferring toner t toward port 190; and toner-agitating member 193 rotatable together with the rotation of toner transfer auger 192. Auger 192 extends in the lengthwise direction of cartridge 37. One end of auger 192 is rotatably supported by the front end wall of cartridge 37, while the other end thereof is rotatably supported by the rear end wall of cartridge 37 through shaft 194. Shaft 194 extends through the rear end wall of cartridge 37, and engageable projection **194*a* is formed at the tip end of shaft 194. As is shown in FIG. 31, engageable projection 194*a* has a cross-shaped section, and a arcuated end face. Claw member 195 having engagement groove 195*a* is fixed to the front end face of cartridge 37**.

Figure 30:
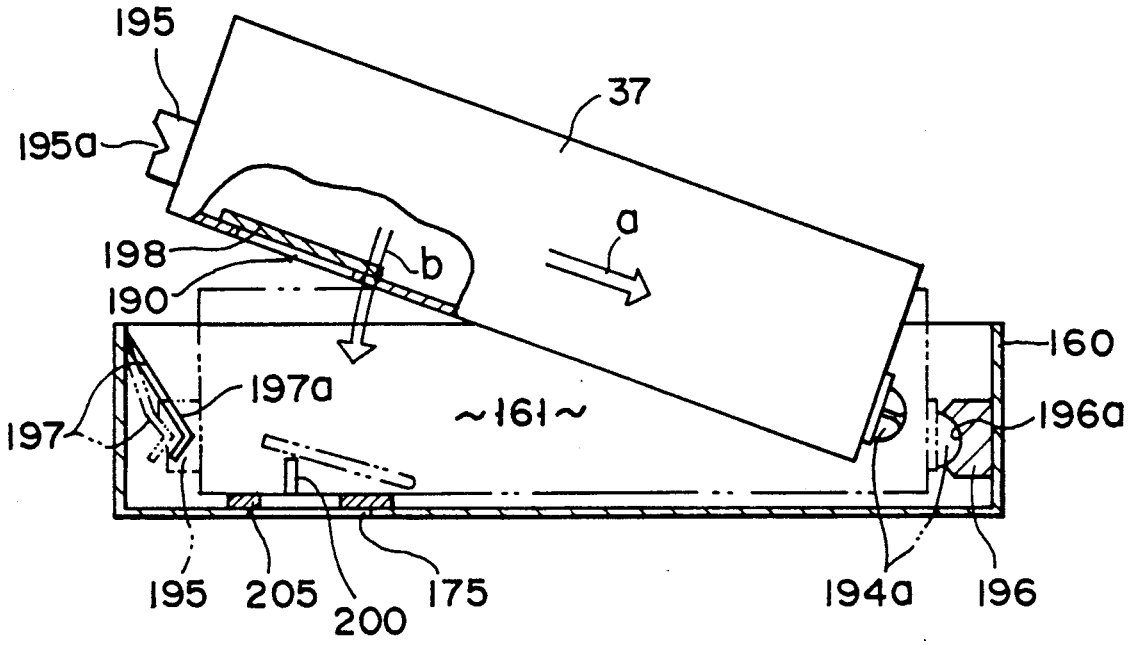
FIG. 30 is partially-cutaway side view showing how the toner cartridge is installed.

As is shown in FIGS. 29 and 30, drive gear 196 is attached to the inner surface of one side wall of toner cartridge-loaded section 161 of developing unit's cover 160. Drive gear 196 has cross-shaped engagement groove **196*a* which is brought into engagement with projection 194*a*. Plate spring 197 is attached to the inner surface of the other side wall of toner cartridge-loaded section 161. Plate spring 197** has engagement portion 197a which is brought into engagement with groove 195a of claw member 195.

Toner cartridge 37 is loaded in section 161 as follows. First, as is shown in FIG. 30, toner cartridge 37 is inserted in section 161 in the direction indicated by arrow a, such that projection 194a contacts groove 196a of drive gear 196. Thereafter, the front end portion of cartridge 37 is pressed downward in the direction indicated by arrow b. As a result, cartridge 37 is easily loaded in section 161, as is indicated by the two-dot chain lines in FIG. 30. Cartridge 37 can be easily removed from section 161 by following the above proceedings in the reverse order. When cartridge 37 has just been loaded in section 161, projection 194a of shaft 194 comes into engagement with groove 196a of drive gear 196. Therefore, auger 192 and toner agitating member 193 are rotated by the driving of motor 185. The engagement between projection 194a and groove 196a is ensured by the urging force of spring 197. Even if projection 194a is not fully engaged with groove 196a at the time of loading cartridge 37, the rotation of drive gear 196 causes projection 194a to be easily fitted in groove 196a. In the copying apparatus of the embodiment, the driving force of drive gear 196 is transmitted to shaft 194 through arcuated projection 194a. Therefore, as compared with a conventional copying apparatus wherein the corresponding driving force is transmitted through a pair of spur gears engaged with each other, the force transmission mechanism of the copying apparatus of this embodiment is advantageous, in that the engagement portions (namely, projection 194a and 196a) are reliably prevented from being damaged at the time of loading and unloading cartridge 37 in section 161. Thus, the reliability of the copying apparatus is improved.

When toner cartridge 37 has been loaded in section 161, shutter 198 for closing toner-replenishing port 190 of cartridge 37 is raised and opened by shutter-raising projection 200 (FIGS. 23 and 29) formed at the location of toner-replenishing port 173 of cover 160. With the rotation of toner transfer auger 192, toner t flows from toner cartridge 37 into developer-storing region 150 through both port 190 of cartridge 37 and port 173 of cover 160, whereby developer-storing region 150 is replenished with toner t.

As is shown in FIG. 29, the driving force of toner-replenishing motor 185 is transmitted to the drive gear 196 through transmission system formed of gears 201-203. When motor 185 is driven in response to a toner replenishment signal supplied from automatic toner sensor 157, auger 192 located inside toner cartridge 37 is rotated, with the result that toner t is made to flow from cartridge 37 into section 150 through ports 190 and 173.

Figure 32:
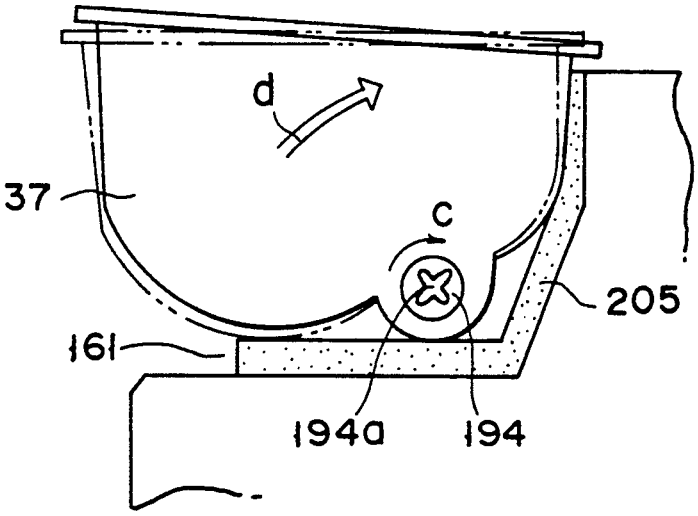
FIG. 32 is a view showing how the toner cartridge swings at the time of replenishment of toner.

As is shown in FIGS. 23 and 32, seal member 205 formed of soft foam resin is attached to the bottom of toner cartridge-loaded section 161 such that seal member 205 is located in the vicinity of toner-replenishing port 173. Section 161 is slightly larger than cartridge 35, so that cartridge 35 loaded in section 161 is slightly rotatable about the rotating axis of auger 192. When cartridge 37 is loaded in section 161, it is placed on seal member 205 and is simultaneously supported by shaft 194 and claw member 197. Therefore, when auger 192 driven by rotating shaft 194 in the direction indicated by arrow c in FIG. 32, toner cartridge 37 is rotated in the direction indicated by arrow d about shaft 194 and is set in the condition indicated by the solid lines in FIG. 32. When the rotation of shaft 194 is stopped, cartridge 37 is returned in the direction opposite to direction d by the repulsive force of seal member 205 and is therefore set in the condition indicated by the two-dot chain lines in FIG. 32. In this fashion, toner cartridge 37 swings during the toner-replenishing operation. Therefore, toner t is uniformly distributed within cartridge 37 and is thus maintained in a condition suitable for toner replenishment.

The electronic copying apparatus having the above-detailed construction makes efficient use of each structural component, so as both to reduce the total number of structural components or parts and to achieve dimensional accuracy between the structural components. As a result, the copying apparatus is reduced in size and reliability in operation can be improved. In addition, the copying apparatus is remarkably easy to handle, since various components of the apparatus are improved in the manner detailed above.

The present invention is not limited to the embodiment mentioned above, and can be modified in various manners without departing from the spirit of the invention.

For example, the shaft of the toner cartridge and the drive mechanism of the main body of the apparatus may be coupled together by providing an engagement groove for the shaft and an engagement projection for the drive gear.

What is claimed is:

1. An image forming apparatus comprising:

lamp means for emitting light to an original and forming an electrostatic latent image on an image carrier by using light reflected from said original, said lamp means having a plurality of light-emitting portions and non-light-emitting portions which are alternately linearly connected to each other; and reflector means for directing the light emitted from said lamp means toward the original, said reflector means having a plurality of openings formed in opposition to said lamp means and permitting part of the light emitted from said lamp means to pass through the openings such that part of the light is directed to said image carrier, to erase the electrostatic latent image remaining on the image carrier, and a plurality of connecting portions formed in opposition only to the non-light-emitting portions of said lamp means and located between adjacent said openings.

2. An image forming apparatus according to claim 1, wherein each of said connecting portions has a width shorter than the non-light-emitting portion if viewed in an axial direction of said lamp means.

3. An image forming apparatus comprising:

an original table for supporting an original thereon;

an image carrier;

exposure means for emitting light to said original and forming an electrostatic latent image on an image carrier by using light from said original, and for emitting light to said image carrier to erase said electrostatic latent image;

drive means for reciprocating said original table;

setting means for setting a number of times as which said drive means is driven, in accordance with the number of copies to be produced; and control means for decreasing the speed of said drive means and reducing the amount of light to be emitted from said exposure means, when said original table is returning from a final reciprocating motion.

4. An image forming apparatus according to claim 1, wherein said connecting portions are opposite to the respective non-light emitting portions of the lamp means.

* * * * *